US011220016B2

(12) United States Patent
Gratsias et al.

(10) Patent No.: US 11,220,016 B2
(45) **Date of Patent: *Jan. 11, 2022**

(54) SHAVER'S HANDLE WITH A LOCK AND RELEASE MECHANISM FOR ENGAGING AND DISENGAGING A RAZOR CARTRIDGE

(71) Applicant: BIC-VIOLEX S.A., Anixi (GR)

(72) Inventors: Spiros Gratsias, Kipseli-Athens (GR); Ioannis-Marios Psimadas, Vrillssia-Athens (GR); Ioannis Bozikis, Koukaki-Athens (GR); Panagiotis Moustakas, Petroupoli (GR); Dimitrios Efthimiadis, Athens (GR); Efstratios Christofidellis, Kifisia (GR)

(73) Assignee: BIC-VIOLEX S.A., Anixi (GR)

( * ) Notice: Subject to any disclaimer, the term of this patent is extended or adjusted under 35 U.S.C. 154(b) by 100 days.

This patent is subject to a terminal disclaimer.

(21) Appl. No.: 16/556,438

(22) Filed: Aug. 30, 2019

(65) Prior Publication Data

US 2020/0023532 A1 Jan. 23, 2020

Related U.S. Application Data

(63) Continuation of application No. 15/533,139, filed as application No. PCT/EP2014/076791 on Dec. 5, 2014, now Pat. No. 10,427,312.

(51) Int. Cl.

| | |
|---|---|
| ***B26B 21/52*** | (2006.01) |
| ***B26B 21/22*** | (2006.01) |
| ***B26B 21/40*** | (2006.01) |

(52) U.S. Cl.

CPC ..... *B26B 21/521* (2013.01); *B26B 21/225* (2013.01); *B26B 21/4018* (2013.01); *B26B 21/522* (2013.01)

(58) Field of Classification Search

None

See application file for complete search history.

(56) References Cited

U.S. PATENT DOCUMENTS 3,052,979 A * 9/1962 Grassau ..... B26B 21/521 30/67
3,646,674 A * 3/1972 Fitzpatrick ..... B26B 21/165 30/64

(Continued)

FOREIGN PATENT DOCUMENTS

EP 1 053 837 A2 11/2000
GB 888738 2/1962

(Continued)

OTHER PUBLICATIONS

International Search Report of PCT/EP2014/076791 dated Aug. 26, 2015.

*Primary Examiner* — Hwei-Siu C Payer
(74) *Attorney, Agent, or Firm* — Polsinelli PC

(57) ABSTRACT

A handle for a shaving razor adapted to releasably support a razor cartridge is provided. The handle includes a handle body and an actuation button. The handle body includes an arm assembly having a pair of arms extending in a plane and being adapted to engage the razor cartridge. The actuation button is configured to move substantially perpendicular to the plane of the pair of arms. The actuation button cooperates with the pair of arms to engage and disengage the razor cartridge.

13 Claims, 19 Drawing Sheets

(56) References Cited

U.S. PATENT DOCUMENTS

| | | | | |
|---|---|---|---|---|
| 3,918,155 | A * | 11/1975 | Atkins | B26B 21/16 30/47 |
| 4,083,104 | A | 4/1978 | Nissen et al. | |
| 4,198,746 | A | 4/1980 | Trotta | |
| 4,266,340 | A | 5/1981 | Bowman | |
| 4,488,357 | A * | 12/1984 | Jacobson | B26B 21/225 30/527 |
| 4,658,505 | A * | 4/1987 | Williams | B26B 21/521 30/47 |
| 4,739,553 | A | 4/1988 | Lazarchik | |
| 4,756,082 | A | 7/1988 | Appprille, Jr. | |
| 5,956,851 | A * | 9/1999 | Apprille, Jr | B26B 21/521 30/47 |
| 6,029,354 | A * | 2/2000 | Apprille, Jr | B26B 21/521 30/47 |
| 6,434,839 | B1 | 8/2002 | Lee et al. | |
| 6,557,265 | B2 * | 5/2003 | Coffin | B26B 21/225 30/50 |
| 7,685,720 | B2 | 3/2010 | Efthimiadis et al. | |
| 8,723,063 | B2 * | 5/2014 | Schnak | H01H 13/023 200/314 |
| 8,844,145 | B2 * | 9/2014 | Psimadas | B26B 21/4062 30/526 |
| 9,707,688 | B2 * | 7/2017 | Giannopoulos | B26B 21/222 |
| 9,757,870 | B2 * | 9/2017 | Giannopoulos | B26B 21/14 |
| 10,427,312 | B2 * | 10/2019 | Gratsias | B26B 21/521 |
| 10,576,648 | B2 * | 3/2020 | Efthimiadis | B26B 21/521 |
| 2004/0181953 | A1 * | 9/2004 | Folio | B26B 21/225 30/527 |
| 2009/0119924 | A1 * | 5/2009 | Bozikis | B26B 21/38 30/45 |
| 2011/0088269 | A1 * | 4/2011 | Walker, Jr | B26B 21/225 30/527 |
| 2011/0167653 | A1 | 7/2011 | Psimadas et al. | |
| 2011/0239475 | A1 * | 10/2011 | Efthimiadis | B26B 21/521 30/526 |
| 2017/0326744 | A1 | 11/2017 | Liberatore | |
| 2017/0334083 | A1 | 11/2017 | Gratsias et al. | |
| 2018/0326606 | A1 * | 11/2018 | Liberatore | B26B 21/4037 |
| 2019/0061186 | A1 | 2/2019 | Efthimiadis | |
| 2020/0023532 | A1 * | 1/2020 | Gratsias | B26B 21/521 |

FOREIGN PATENT DOCUMENTS

| | | | |
|---|---|---|---|
| GB | 2 078 589 | A | 1/1982 |
| GB | 2 086 790 | A | 5/1982 |
| WO | 2009/027910 | A2 | 3/2009 |
| WO | 2010/037418 | A1 | 4/2010 |
| WO | 2014/094907 | A1 | 6/2014 |

* cited by examiner

SHAVER'S HANDLE WITH A LOCK AND RELEASE MECHANISM FOR ENGAGING AND DISENGAGING A RAZOR CARTRIDGE

CROSS-REFERENCE TO RELATED APPLICATIONS

This application is a continuation application of U.S. application Ser. No. 15/533,139, filed Jun. 5, 2017, now U.S. Pat. No. 10,427,312, which is a national stage application of International Application No. PCT/EP2014/076791, filed Dec. 5, 2014, the entire contents of which are incorporated herein by reference.

FIELD

The embodiments of the present invention relate to a wet shaving razor that includes a razor handle with a release mechanism for engaging and disengaging a disposable razor cartridge and a method of manufacture such a razor.

BACKGROUND OF INVENTION

Document WO2009027910 recites a shaver having a lock and release mechanism operated by an ejector button. The ejector button is mounted on the handle body and includes a concave area designed for placing user's finger during actuation of a button.

One purpose of the present invention is to improve the shavers, in particular with regard to comfort of use and ergonomy.

SUMMARY OF THE INVENTION

The handle for a shaving razor according to an embodiment of the present invention is adapted to releasably support a razor cartridge; the handle includes an actuation button actuatable to release the razor cartridge. The actuation button includes a substantially spherical part (i.e. with spherical shape or little deviation from a spherical shape) positioned so that a user's finger comes in contact therewith when actuating the actuation button.

Due to these features, the comfort of use and ergonomics are improved. In particular, the actuation button with its substantially spherical part, offers more freedom to a user when resting his/her finger on the button both during shaving and/or during actuation of the button.

Various embodiments of such a handle may incorporate one or more of the following features:

the handle further includes a handle body, an arm assembly having two arms provided on the handle body and adapted to engage at least a razor cartridge for supporting it, the arms being movable between a rest position for engaging at least the razor cartridge and a release position for disengaging at least the razor cartridge. The actuation button is movably mounted on the handle body, the actuation button cooperating by camming action with the arm assembly so that the actuation button moves the two arms into the release position when the button is actuated;

the handle body is made of plastic;

the substantially spherical part has an average density different from a density of material of the handle body;

the difference between the average density and the density of the material of the handle body is at least 10%;

the substantially spherical part includes at least two different materials with different densities;

the substantially spherical part has an average density higher than the density of material of the handle body (By this provision the actuation button is multifunctional. The actuation button is adapted to release a razor cartridge from the handle and serves as an additional weight to the handle without a need for additional weight to be disposed on or within the main body of the handle and/or without a need to use inserts fitted therein and/or without a need to increase the plastic volume of the handle or use of special material of higher density during the manufacture of the main gripping portion of the handle. Such an actuation button also improves balance of the handle for a smooth and comfortable shave)

the substantially spherical part of the actuation button is made from metal (or the whole button or at least part of the button can be made of metal);

the arm assembly is movably mounted on the handle body; the handle body and the arm assembly are separate pieces;

the actuation button is mounted on the handle body so that the actuation button slides substantially along a longitudinal direction of the handle;

the handle includes an actuation button movably mounted on the handle body between a lifted position and a depressed position, wherein the actuation button is depressed inside the handle body; the actuation button moves the two arms in the release position when the button is pressed to the depressed position; the two arms bias the actuation button toward the lifted position when the actuation button is released;

the two arms extend substantially in a common plane and the actuation button is mounted on the handle body, so that the actuation button can move substantially perpendicular to the common plane;

the handle includes at least one elastic portion through which an elastic return force is applied to the two arms when the two arms are moved from the rest position towards the release position; the handle includes a guard member and a pair of stop members adapted to come into abutment against the guard member when the two arms are in the release position;

the at least one elastic portion is a U-shaped elastic member interconnecting the two arms; the elastic member is winding around the guard member and comprising a return force generation portion and safeguard portions acting as stop members; the safeguard portions of the U-shaped elastic member come into abutment against the guard member as the two arms are in the release position, e.g. the safeguard portions of the U-shaped elastic member may prevent the return force generating portion of the U-shaped elastic member from reaching the point of the yield or the ultimate tensile stress exerted thereon.

the two arms have proximal parts closer to the actuation button and distal parts further away from the actuation button, the two arms being pivotable between the rest position and the release position around two pivot points; the proximal parts of the two arms are moved apart during actuation of the actuation button, thereby rotating around the pivot points and resulting in the distal parts of the two arms coming closer together for releasing the razor cartridge from the handle;

the arm assembly further includes a connecting portion, the two arms are connected to the connecting portion by hinges and extending from the hinges to respective distal parts adapted to engage with the razor cartridge, the two arms are pivotable between the rest position and the release position around the hinges;

the arm assembly is slideably mounted relative to the handle body along a longitudinal direction of the handle;

the connecting portion includes an inclined surface, with which the actuation button cooperates by camming action when the actuation button is actuated so as to slide the arm assembly in the longitudinal direction, the arms cooperate by camming action with the handle body so as to be moved to the release position when the arm assembly is slid upon actuation of the actuation button;

the hinges are elastically deformable to allow movement of the arms between the rest position and the release position;

the connecting portion includes a cavity in which is configured to receive the button, the inclined surface is formed in a rear portion of the cavity opposed to the distal ends of the arms, the actuation button is movably mounted in the cavity between a lifted position and a depressed position wherein the actuation button is depressed inside the cavity and presses by camming action on the inclined surface, the actuation button is guided related to the handle body to move substantially perpendicularly to the longitudinal direction when depressed;

the actuation button is a sphere and is guided in a hole belonging to a cover which covers the arm assembly and which is rigid with the handle body, the hole being dimensioned to avoid the actuation button from escaping the cavity;

the stop members protrude inwardly towards each other from the two arms and rest against the guard member as the two arms move towards the release position, e.g. preventing the return force generating portions from reaching the point of the yield or the ultimate tensile stress exerted thereon;

the actuation button is mounted on the handle body so that the actuation body slides substantially along a longitudinal direction of the handle;

the actuation button includes a button body and the substantially spherical part, the button body being mounted on the handle body so that the button body slides substantially along the longitudinal direction of the handle, the substantially spherical part being movably mounted in the button body and being guided relative to the handle body substantially perpendicular to the longitudinal direction of the handle between a lifted position, where the substantially spherical part is lifted outside the button body, and a depressed position where the substantially spherical part is depressed inside the button body, the substantially spherical part being elastically biased toward the lifted position and cooperating with the button body so as to prevent the button body from sliding when in lifted position and so as to enable the button body to slide when in depressed position;

the button body has a cavity which is open toward the handle body and a cover partially covering the cavity opposite to the handle body, the cover having a through hole through which the substantially spherical part protrudes outside the cavity when the substantially spherical part is in the lifted position, the handle body having a guide extending in the cavity of the button body toward the cover, the substantially spherical part bearing against the guide toward the arm assembly and the cavity being dimensioned so that the substantially spherical part can enter entirely in the cavity in the depressed position and the substantially spherical part can be at least partially covered by the cover of the button body when the button body is slid toward the arm assembly;

the handle is adapted to pivotally support a removable razor cartridge, the guard member has return means for returning the razor cartridge to a rest position;

the substantially spherical part may constitute any portion of a sphere, for instance a half-sphere;

the substantially spherical part may be visible for a user;

the substantially spherical part of the actuation may protrude outwardly from the handle body;

the substantially spherical shape may provide multidirectional support for user's finger, not defining any designated area for a user to rest his finger on (By this provision, the substantially spherical part can serve as a finger rest area offering more freedom for manipulating the shaver both during the shaving and releasing the cartridge by actuating the release button. Moreover, the spherical part increases ergonomic nature of the actuation button);

the actuation button or at least the substantially spherical part can be adapted to serve as a finger rest area for user's digit during shaving;

the button itself may have a substantially spherical shape (the sphere is easy to mold with less effort spent on defining complex features of the button, by this provision the manufacturing process is simplified with reduced need for precision during the manufacture of small and delicate components, the symmetric properties of the substantially spherical shape with the directional independency put less demands on precision aspects of the machinery used during the assembly process, the probability of breaking during an accident, e.g. dropping of the shaver, or during a proper constant long-term use of the shaver is decreased, a handle with minimum number of components and less complex features supports the long-term life of the handle and reduces the risk of accidentally breaking the handle or one of its key components).

Another object of the present invention is a shaving razor including the handle with any of the above described features and a cartridge mounted on the handle, the cartridge being engaged by the two arms when the two arms are in the rest position and the cartridge being disengaged from the two arms when the two arms are in the release position, the cartridge being released from the handle upon actuation of the actuation button.

The above and other objects and advantages of the invention will become apparent from the detailed description of various embodiments of the invention, considered in conjunction with the accompanying drawings.

DETAILED DESCRIPTION OF THE MAIN EMBODIMENTS

The following description of the main embodiments of the invention is made with reference to the accompanying drawings, where the same reference numbers denote identical or similar elements.

In the description, the X-axis represents substantially the longitudinal direction of the handle, whereas the Y-axis is perpendicular to the X-axis; for instance the Y-axis may represent the pivot axis of the razor cartridge.

Figure 1:
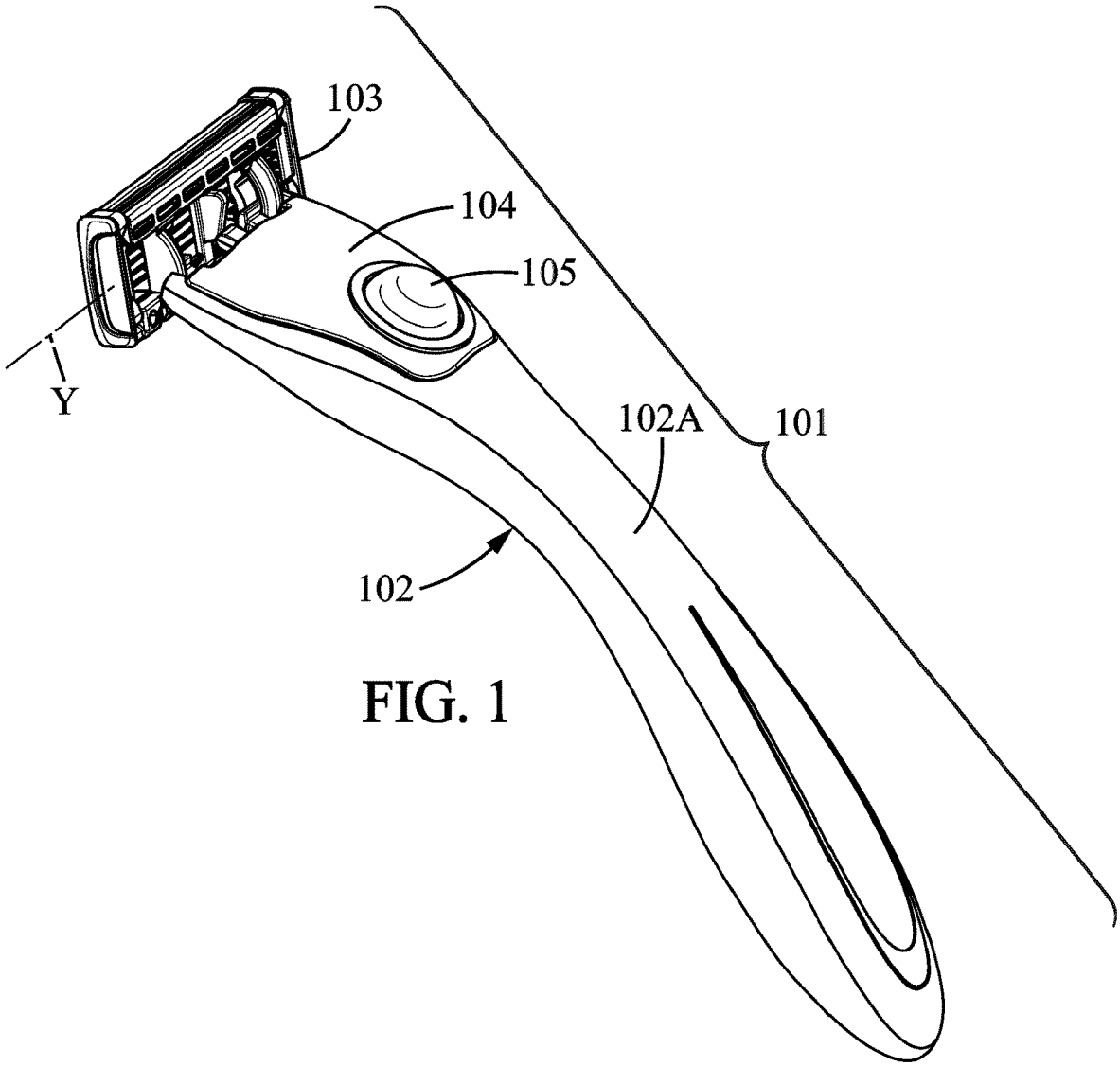
FIG. 1 is an overall view of the shaving razor according to the first embodiment of the invention.

FIG. 1 illustrates a shaving razor 101 according to a first embodiment of the present invention, including a handle 102, a razor cartridge 103, a cover 104 and an actuation button 105. The handle 102 may be elongated, including an elongated handle body 102A. The handle body 102A may include a gripping portion. The handle body 102A may be further made of low-cost material, such as a plastic material. Alternatively, the handle body 102A may be manufactured from any other suitable material, such as a metal. The handle body 102A according to the present invention may include as little components as possible. The handle body 102A may be made as one piece. The handle body 102, the cover 104 and/or the button 105 may have at least one finger rest area. The finger rest areas may be manufactured, for instance, from rubber or the like.

The shaving razor 101 is adapted for use with disposable razor cartridges. The shaving razor 101 may be provided with an arm assembly including two arms 106, as can be seen on FIG. 2. The arms 106 are adapted to engage and disengage the razor cartridge 103. For example, the two arms 106 may be movable between a rest position, in which the cartridge 103 is attached to the handle 102, and a release position, in which the two arms 106 come closer together, thereby releasing the razor cartridge 103 from the handle 102.

The cartridge 103 may be provided with a pair of rims 103A. The rims 103A may be adapted to engage with a pair of shell bearings 119A provided on the arms 106. The shell bearings 119A and the rims 103A are adapted to support pivotal movement of the cartridge 103 around the Y-axis. Alternatively, the arms 106 may be compatible with an intermediate structure attached to the cartridge 103. The arms 106 then might engage and disengage with the intermediate structure, or both the cartridge 103 and an intermediate structure.

When moving from the rest position towards the release position, an elastic return three is applied to the two arms 106, so that the arms 106 are elastically biased towards the rest position. In one embodiment, the elastic return force may be represented by an elastic member 107 interconnecting the arms 106. The elastic member 107 pushes both arms 106 away from each other, thus returning them both to the rest position. Alternatively, more than one elastic component may be incorporated in the handle 102, each elastic component applying return force to at least one of the arms 106.

The actuation button 105 shown on FIGS. 1-4 of the accompanying drawings is movably mounted on the handle body 102A. The actuation button 105 is adapted to be movable between a lifted position and a depressed position. The actuation button 105 cooperates by means of the camming action with the pair of arms 106, such that upon actuation of the actuation button 105 into the depressed position, the arms 106 are moved closer together into the release position, thus disengaging from the cartridge 103. When the actuation button 105 is released by a user, the pair of arms 106 is elastically biased into the rest position, and simultaneously by means of the camming action, the pair of arms 106 force the actuation button 105 back into the lifted position. Detailed description of the lock and release mechanism will be provided below.

The actuation button 105 may have a substantially spherical part. The substantially spherical part may constitute any portion of a sphere, for instance a half-sphere. The substantially spherical part is visible for a user. Alternatively, the actuation button 105 itself may have substantially spherical shape as shown on FIGS. 1-4. The substantially spherical actuation button 105 may be manufactured so that the actuation button 105 adds weight to the distal part of the handle 102. With a substantially spherical actuation button 105, the manufacturing process of the actuation button 105, as well as the whole lock and release mechanism is simplified, which makes the shaver assembly less costly. One advantage of the substantially spherical actuation button 105 is that the sphere is symmetrical and easy to mold. The symmetric shape also simplifies the whole manufacturing process, since there is no directional dependency, when placing the sphere in the handle body 102A during an assembly of the handle 102. The substantially spherical shape of the actuation button 105 is also comfortable for a user when using the button 105 as a finger rest area.

In at least one embodiment, the two arms 106 extend substantially in a common plane XY. The button 105 is mounted in the handle body 102A, so that the button 105 can move in a direction substantially perpendicular to the plane XY. The button 105 is restricted in motion within the plane XY by being fixed inside the hole 127 of the cover 104. Thus, the button 105 is restricted in movement to the sides of the handle 102 and along the longitudinal direction of the handle 102. The restriction in movement of the button 105 along the longitudinal direction of the handle 102 inside the handle 102 is ensured by blocking protrusions 113. Additionally, the button 105 is restricted from rotational movement. The restriction in rotational movement can be achieved for example by covering the surface of the button 105 with a suitable material, such as rubber or other elastomeric materials, increasing the friction between the button 105 and the rim of the hole 127. The rubber or other elastomeric material may also serve as suitable finger rest area. The actuation button 105 may thus also serve as a support area for resting user's finger during shaving. Therefore the actuation button 105 provides support for the user's finger, which is close to the blades, thus the motion of the blades on a user's skin can be led more conveniently during shaving.

The actuation button 105 may be provided with an outer layer adapted to prevent slipping of a user's finger when the finger is rested against the button 105. Alternatively, the button 105 may be manufactured from a material which inherently restricts slippery motion when in contact with user's skin. Examples of such material preventing slippery motion are elastomeric materials, such as rubber or similar.

The material of the actuation button 105 may have a different density from the density of the material of the handle body 102A. Thereby the balance of the handle 102 can be improved. In at least one embodiment of the present invention, the difference between the density of the actuation button 105 and the density of the handle body 102A is at least 10% of the density of the handle body 102A.

The material of the actuation button 105 may be chosen among materials with density higher than the density of a material used for manufacture of the handle body 102A. In an embodiment of the present invention, the button 105 is made of metal. The weight of the actuation button 105 helps to improve the user's feel during shaving and to enhance shaving performance. Such a weight in the distal portion of the handle 102 makes the process of shaving more natural and convenient, especially when the handle body 102A is molded from light low-cost material, such as plastic material. The additional weight placed in the button 105 is close to the blades. Therefore the balance of the handle 102 during its use might be improved.

It is taken into consideration that the additional weight of the actuation button 105 is lower than the elastic return force exerted by the elastic portion, for example the elastic member 107, of the two arms 106. This is so as to avoid unexpected spontaneous release of the cartridge 103 merely by the weight of the button 105 without a user actually pushing the button 105. This provision also ensures that the actuation button 105 can be moved back to the lifted position, when the arms 106 are elastically biased to the rest position.

Figure 2:
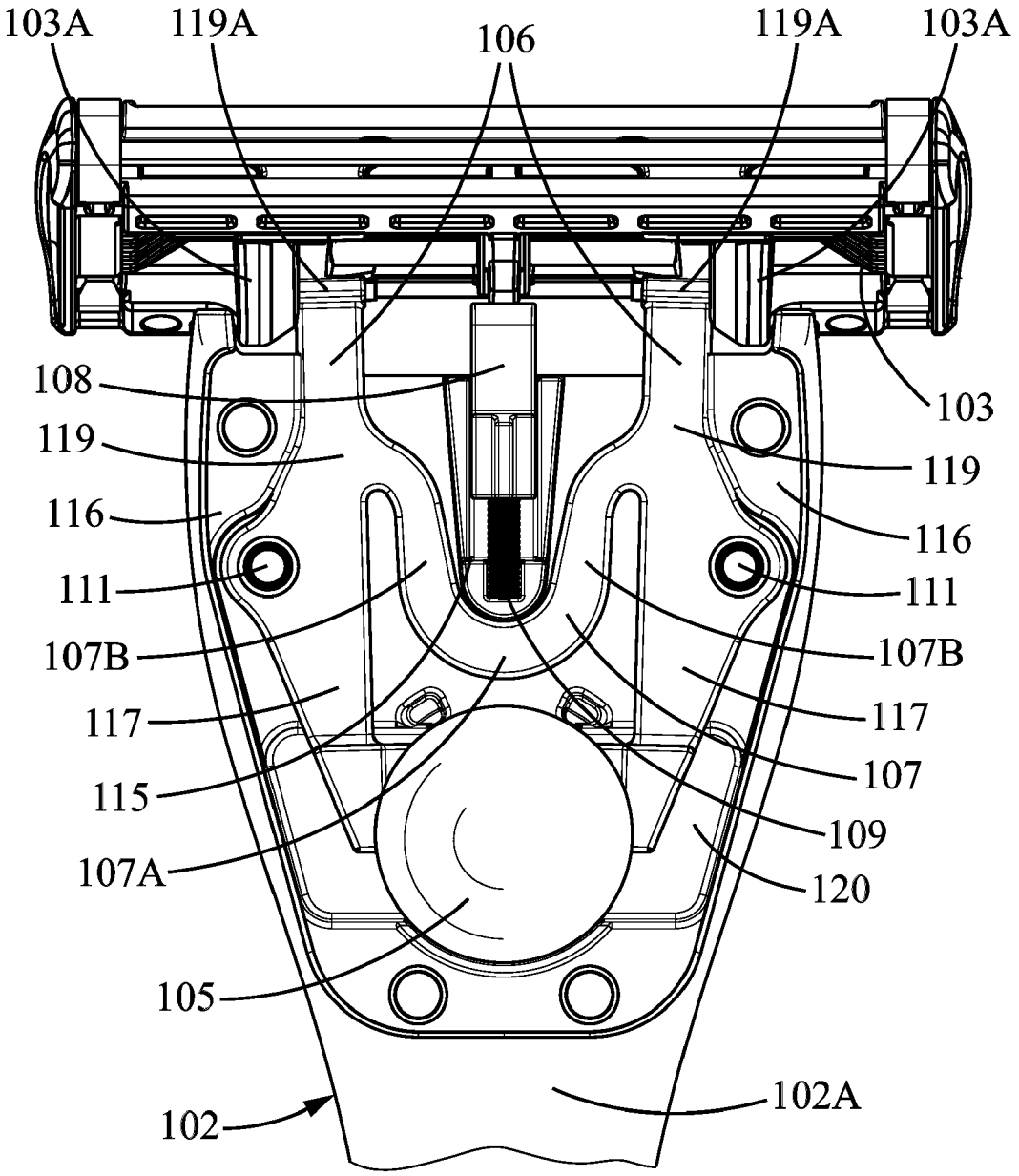
FIG. 2 is a front view of the distal part of the handle showing the lock & release mechanism according to the first embodiment of the invention.

FIG. 2 shows the lock and release mechanism of the handle 102 according to the first embodiment of the invention. The lock and release mechanism includes two arms 106, the actuation button 105 and an elastic member 107. The elastic member 107 includes a return force generating portion 107A. The elastic member 107 further includes safeguard portions 107B. In one embodiment the elastic member 107 is a U-shaped elastic member winding around a guard member 115 as displayed on FIGS. 2-4. The safeguard portions 107B act as stop members. The safeguard portions 107B and the guard member 115 prevent the return force generating portion 107A of the elastic member 107 from reaching the point of the yield or the ultimate tensile stress exerted thereon, the former being the point of maximum stress, that the material can withstand before undergoing permanent plastic deformation, and the latter being the point at which the material breaks. When the actuation button 105 is pressed into the depressed position, the two arms 106 come closer together, thereby releasing the razor cartridge 103 from the handle 102. At the same time, the safeguard portions 107B are pushed towards each other, so that the safeguard portions 107B rest against the guard member 115. This prevents the arms 106 from moving further together, thus stopping in the release position and reducing the risk of the return force generation portion 107A stretching too much and reaching the point of the yield or the ultimate tensile stress exerted thereon. By such provision the functionality and durability of the elastic member 107 is improved. The probability of accidently breaking the elastic member 107 by straining it too much and causing excessive deformation is reduced. The elastic member is thus less vulnerable to an improper or excessive use, and the reliability of the whole shaver is therefore also improved. With the protective means, such as the guard member 115 and the stop members 107B, the lifetime of the shaver might be increased; moreover the user's costs spent on shaving are lowered.

Figure 3:
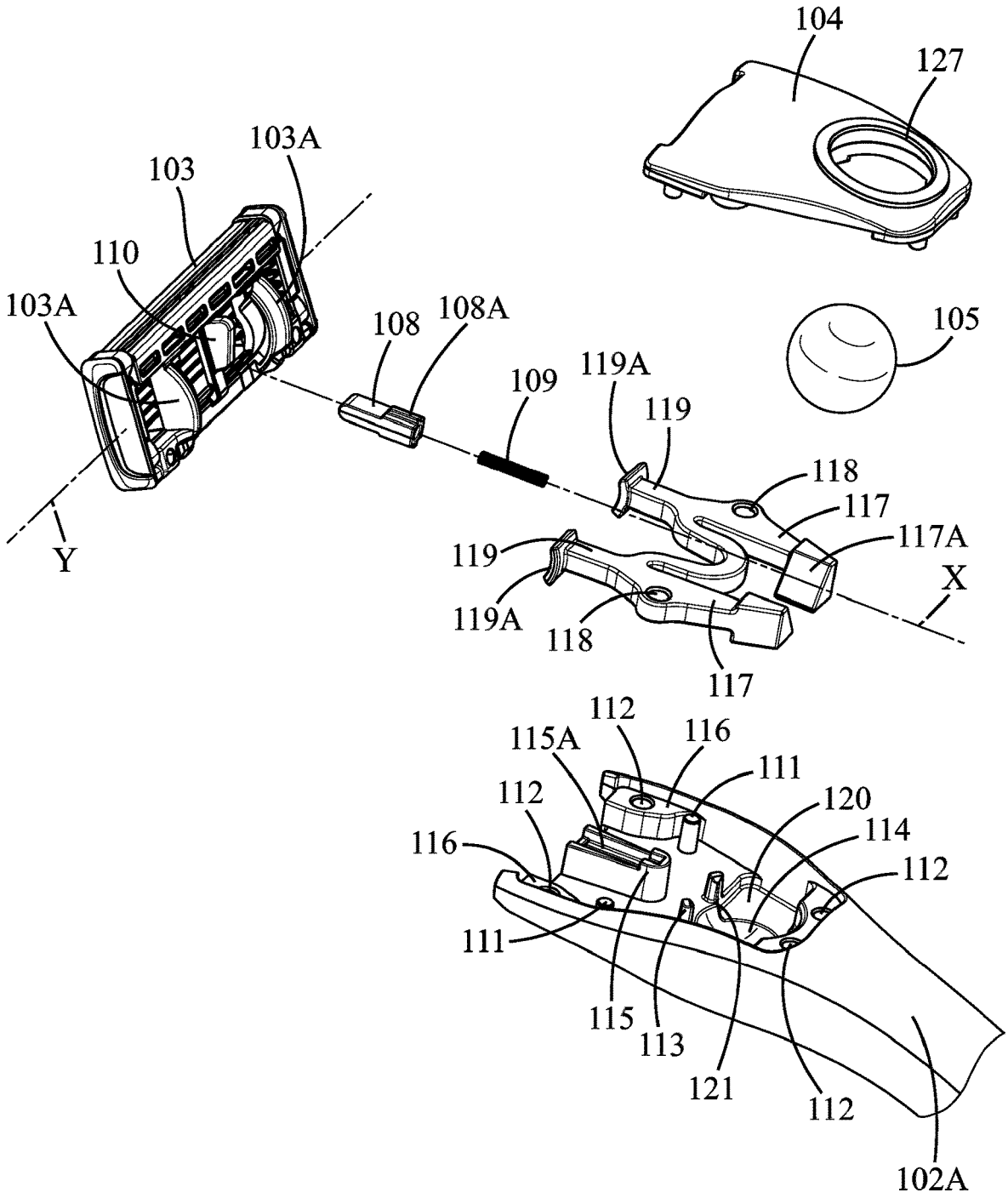
FIG. 3 shows an exploded view of the distal part of the handle according to the first embodiment of the invention.
Figure 4:
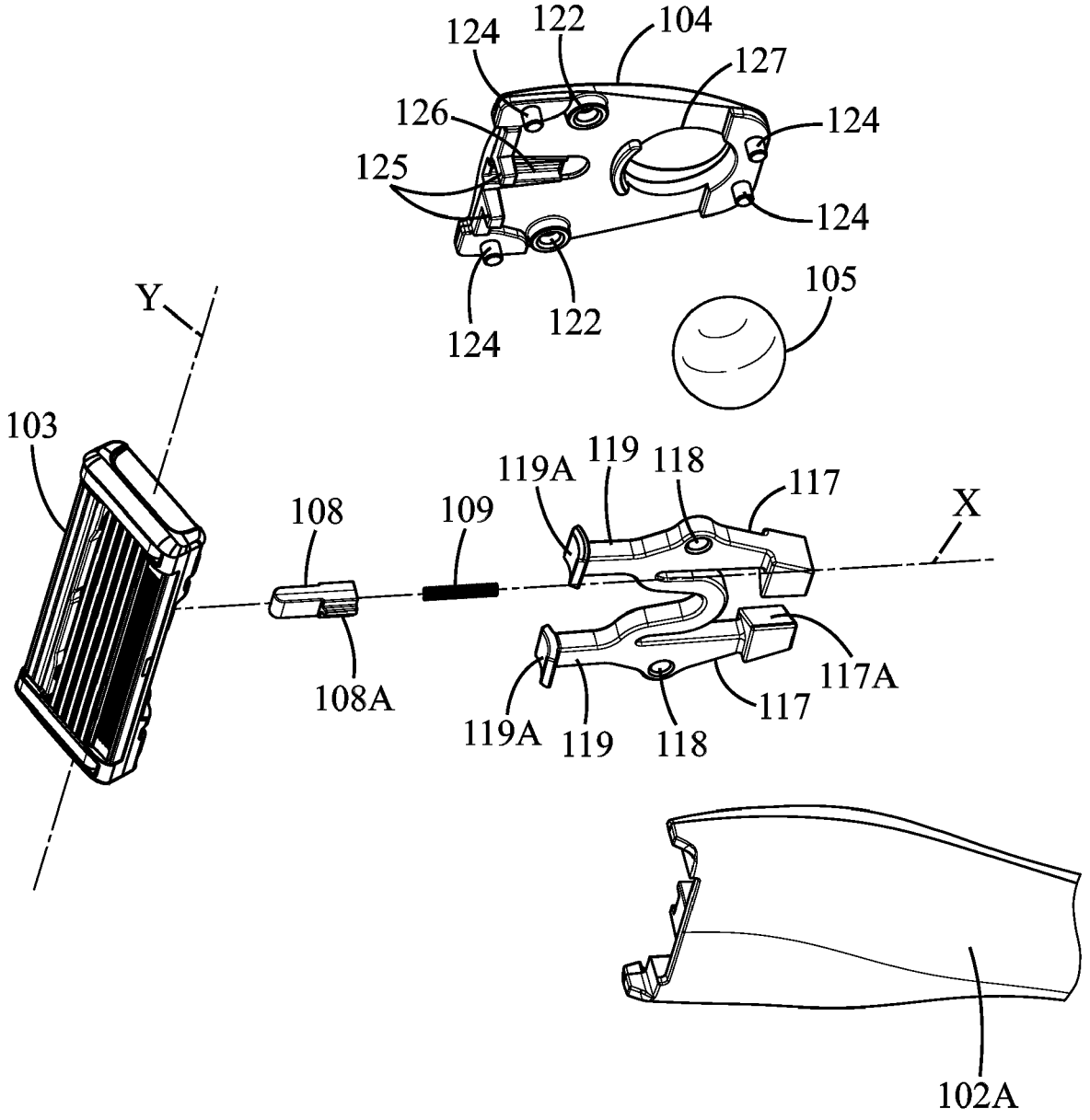
FIG. 4 displays an exploded view of the distal part of the handle according to the first embodiment of the invention from another perspective.

FIGS. 2-4 show the two arms 106 comprising distal parts 119 and proximal parts 117. The distal parts 119 of the two arms 106 may be adapted to engage or disengage the razor cartridge 103. For example, as shown on FIGS. 2-4 the distal part 119 of the antis is provided with shell bearings 119A. The shell bearings can be adapted to fit into the rims 103A provided on the cartridge 103. The shell bearings 119A and the rim 103A can be adapted to allow pivotal movement of the cartridge 103 around the pivot axis Y. Any alternative means for attaching the pivoting razor cartridge 103 might be used, such as pins and corresponding holes, or the like.

The pair of arms 106 is pivotally mounted on the handle body 102A with respect to the pivot points. The pivot points may be in a form of a pair of pins 111 protruding from the handle body 102A. For example each one of the pins 111 could be fitted into each respective one of a pair of openings 118 provided on the arms 106 as illustrated on FIGS. 3-4. The openings 118 can be provided substantially in the middle of the length of the pivot arms 106. The pair of arms 106 is constructed symmetrically with respect to the X-axis. Any alternative solutions enabling relative rotational movement between the handle body 102A and the two arms would also be possible. For example, pins may be provided on the pair of arms 106 and the corresponding openings may be disposed in the handle body 102A.

In order to provide for a smooth movement of the proximal parts 117 of the arms 106, there may be a depressed area 120 in the handle body 102A surrounding the proximal parts 117. When returned back to the rest position, the distal parts 119 of the two arms 106 may be supported by two rest projections 116 protruding from each side of the handle 102. In the rest position the distal parts 119 may lean against the rest projections 116.

When the button 105 is in the depressed position, the button 105 is depressed inside the handle body 102A. To this end, there is a cavity 114 hollowed in the handle body 102A as illustrated in FIG. 3. In the cavity 114, the actuation button 105 can be seated conveniently when actuated into the depressed position. As the button 105 is pressed from the lifted position towards the depressed position inside the handle 102, the button 105 is lodged into the cavity 114.

The proximal parts 117 of the arms 106 may each have an inclined surface 117A. For example, the inclined surfaces 117A are planar. The inclined surfaces 117A can be facing each other. When the arms 106 are in the rest position and the button 105 is in a lifted position, there are two side portions of the button 105, which rest against the inclined surfaces 117A. In the lifted position, the button 105 is seated between the cover 104 and the inclined surfaces 117A. During the actuation of the button 105, the proximal parts 117 can be moved apart by pressing the button 105 between them. As the proximal parts 117 are moved apart, they rotate around the pins 111. Simultaneously, the distal parts 119 move closer together, thereby the distal parts 119 release the cartridge 103 from the handle 102. The sides of the button 105 adjacent to the inclined surfaces 117A are adapted to slide along the inclined surfaces 117A, as the button 105 is actuated. For example, a substantially spherical shape of the button 105 is compatible with inclined surfaces 117A as displayed on FIGS. 3-4. Alternatively, triangular shape of the portion of the button 105, which contacts the inclined surfaces 117A, would be also possible.

In an alternative embodiment, the arms 106 may be adapted so that the distal parts 119 move apart, when the cartridge 103 is being released. Correspondingly, the proximal parts 117 of the arms may move closer during the release of the cartridge 103. The actuation button 105 may be adapted to force the proximal parts 117 together, when the button is actuated. The proximal parts 117 may thus alternatively be provided with inclined surfaces 117A with their faces oriented away from each other. The actuation button 105 may alternatively include a recessed portion, for example of triangular shape, so that when the button 105 is actuated, the recessed portion contacts and slides along the inclined surfaces 117A, thereby forcing them to move closer to each other.

As depicted in FIG. 3, a set of openings 112 may be provided on the handle 102. The openings 112 can engage with a set of corresponding protrusions 124 (shown in FIG. 4) disposed on the cover 104. The cover 104 can be press-fitted in a set of openings 112, in order to be secured to the handle body 102A. Additionally, the cover may be provided with a pair of pockets 122 configured to cover the pins 111, around which the pair of arms 106 is rotating. Furthermore, a pair of posts 125 may be present on the inner side of the cover 104. Each of the pair of posts 125 can be fitted between the guard member 115 and one of the arms 106 on the distal-most part of the handle body 102A. There may also be a hole in the cover 127 abutting the actuation button 105 so that the button 105 is restricted in side-to-side motion. In case the actuation button 105 has a substantially spherical shape, the hole 127 has a circular shape. The hole 127 can have a diameter smaller than the diameter of the button 105. In the illustrated embodiment, the button 105 is retained inside the handle body 102A. Furthermore, the button 105 may partially protrude outside through the hole 127 in the cover 104.

In at least one embodiment, the cartridge 103 is allowed to pivot around the axis Y, The handle 102 is provided with a return means adapted to return the cartridge 103 to a neutral position when the cartridge 103 is rotated. The cartridge 103 is held on the handle 102 by shell bearings 119A. The shell bearings 119A are adapted to engage with rims 103A provided on the cartridge 103. The rims 103A and the shell bearings 119A enable the cartridge 103 to rotate around the axis Y during shaving. Other pivoting means, which allow the cartridge 103 to pivot around the Y-axis, are also possible, for example pins provided on the arms 106 and the corresponding holes disposed on the cartridge 103.

In at least one embodiment, the guard member 115 cooperates with stop members 107B in order to prevent the return force generation portion 107A of the elastic member 107 from reaching the point of the yield or the ultimate tensile stress exerted thereon. Furthermore, the guard member 115 encloses return means for returning the pivoting cartridge 103 to a neutral position. Therefore the guard member 115 serves as a multifunctional element, the number of components included in the lock and release mechanism of the handle 102 is reduced, and the manufacturing process of the handle 102 is simplified. The guard member 115 may be molded as a part of the handle body 102A. The guard member 115 may be molded in the distal-most part of the handle 102, neighboring the cartridge 103. The guard 115 lies on the X-axis of the handle 102.

The guard member 115 may accommodate any means for returning the cartridge 103 to a neutral position. According to an embodiment of the present invention, the return means can be a combination of a pusher 108 and a spring 109. The spring 109 may generate the required elastic force for returning the cartridge to a neutral position. The pusher 108 can cooperate with a corresponding cam surface 110 of the cartridge 103. The pusher 108 may be located inside the guard 115. The pusher 108 can be covered with the cover 104, so that the pusher 108 is restricted in movement in all the directions other than that along the X-axis. The pusher 108 can be adapted to reciprocate inside the guard 115. To this end, the pusher 108 may be provided with at least one protrusion 108A. For example, the pusher 108 includes two protrusion 108A provided on the opposite sides of the pusher 108. In at least one embodiment, one such protrusion 108A fits inside a groove 115A provided on the inside of the guard 115. The cover 104 can also be provided with a groove 126, in which the other protrusion 108A is located during movement of the pusher 108.

Figure 5:
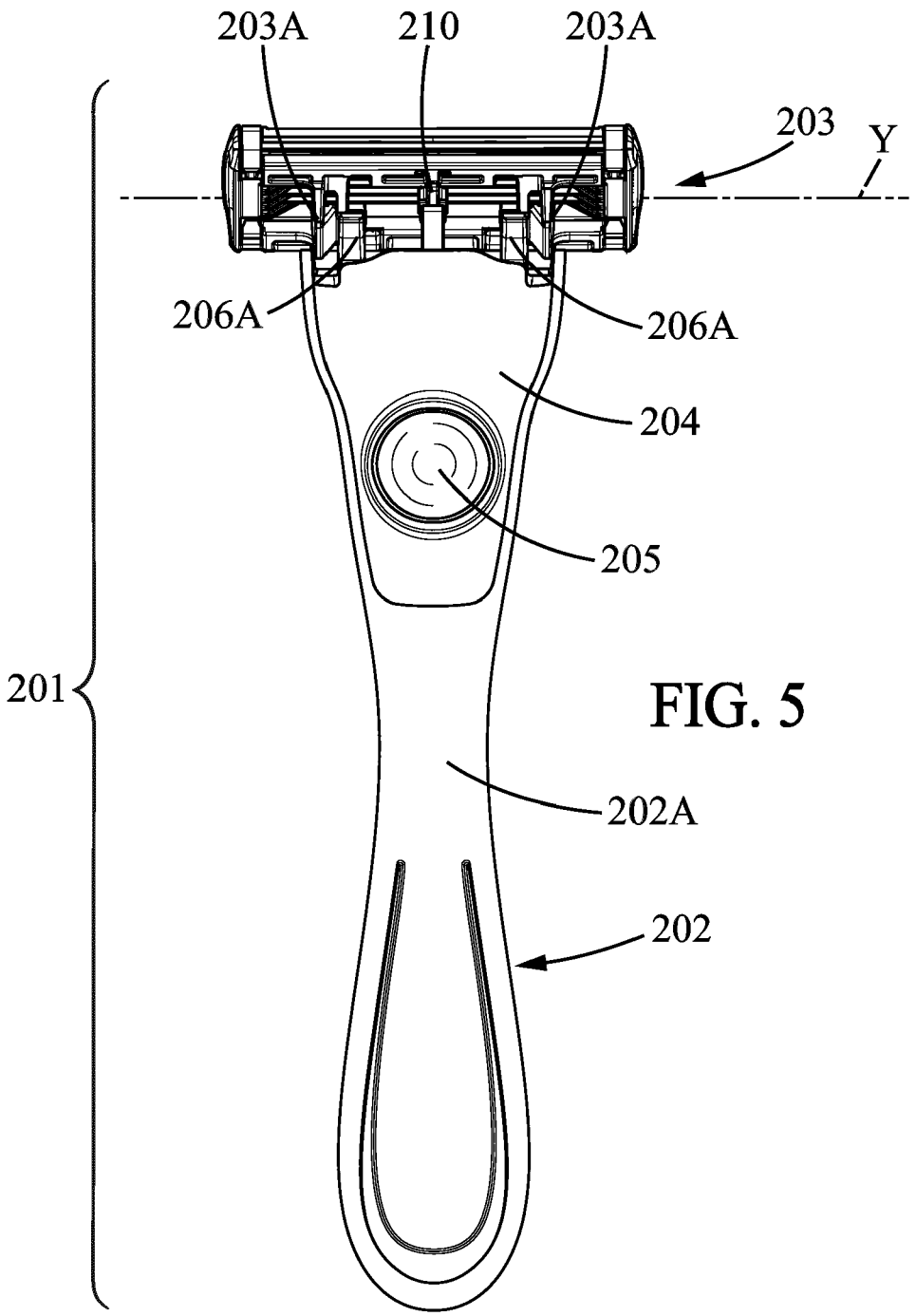
FIG. 5 is a front view of the shaving razor according to the second embodiment of the invention.

Illustrated on FIG. 5 is a shaving razor 201 according to a second embodiment of the present invention, including a handle 202, a razor cartridge 203, a cover 204 and an actuation button 205. The handle 202 may have an elongated handle body 202A, having an elongated gripping portion. The handle body 202A may be further made of a low-cost material, such as a plastic material. Alternatively, the handle body 202A may be manufactured from any other suitable material, such as a metal. The handle body 202A according to the present invention includes as little components as possible. The handle body 202A can be made as one piece. The handle body 202A, the cover 204 and/or the button 205 may include at least one finger rest area. The finger rest areas may be manufactured for instance from rubber or the like.

The shaving razor 201 is adapted for use with disposable razor cartridges. The shaving razor may be provided with an arm assembly comprising two arms 206 and a connecting portion 214 as can be seen on FIG. 6. The arms 206 are adapted to engage and disengage the razor cartridge 203. For example, the two arms 206 may be movable between a rest position, in which the cartridge 203 is attached to the handle 202, and a release position, in which the two arms 206 come closer together, thereby releasing the razor cartridge 203 from the handle 202.

The cartridge 203 may be provided with a pair of rims 203A. The rims 203A may be adapted to engage with a pair of shell bearings 206A provided on the arms 206. The shell bearings 206A and the rims 203A can be adapted to support pivotal movement of the cartridge 203 around the Y-axis. Alternatively, the arms 206 may be compatible with an intermediate structure attached to the cartridge 203. The arms 206 then can engage and disengage with the intermediate structure, or both the cartridge 203 and an intermediate structure.

When moving from the rest position towards the release position, an elastic return force is applied to the two arms 206, so that the arms 206 are elastically biased towards the rest position. In at least one embodiment, the elastic return force may be generated by elastic connections between the pair of arms 206 and a connecting portion 214. For example, the pair of arms 206 and the connecting portion 214 may be connected via the elastic connections. The pair of arms 206, the elastic connections, and the connecting portion 214 may be manufactured as a single piece. In at least one embodiment, the pair of arms 206 is made from elastic material. The pair of arms 206 may be directly connected to the connecting portion 214, without the presence of elastic connections. The elastic return force may be generated by the arms 206 themselves. The arms 206 may include hinges 207 generating the return force. For example, hinges 207 are located at points where the arms 206 protrude from the connecting portion 214, as depicted for example in FIG. 6. The connecting portion 214 and the pair of arms 206 can extend in the XY plane. The arms 206 are movable between the rest position, in which the arm 206 engage the cartridge 203, and the release position, in which the arms 206 disengage the cartridge 203. The hinges 207 may be adapted to generate an elastic return force. When the two arms 206 are in the release position, the hinges 207 push both arms 206 away from each other, thus returning them hack to the rest position.

Figure 6:
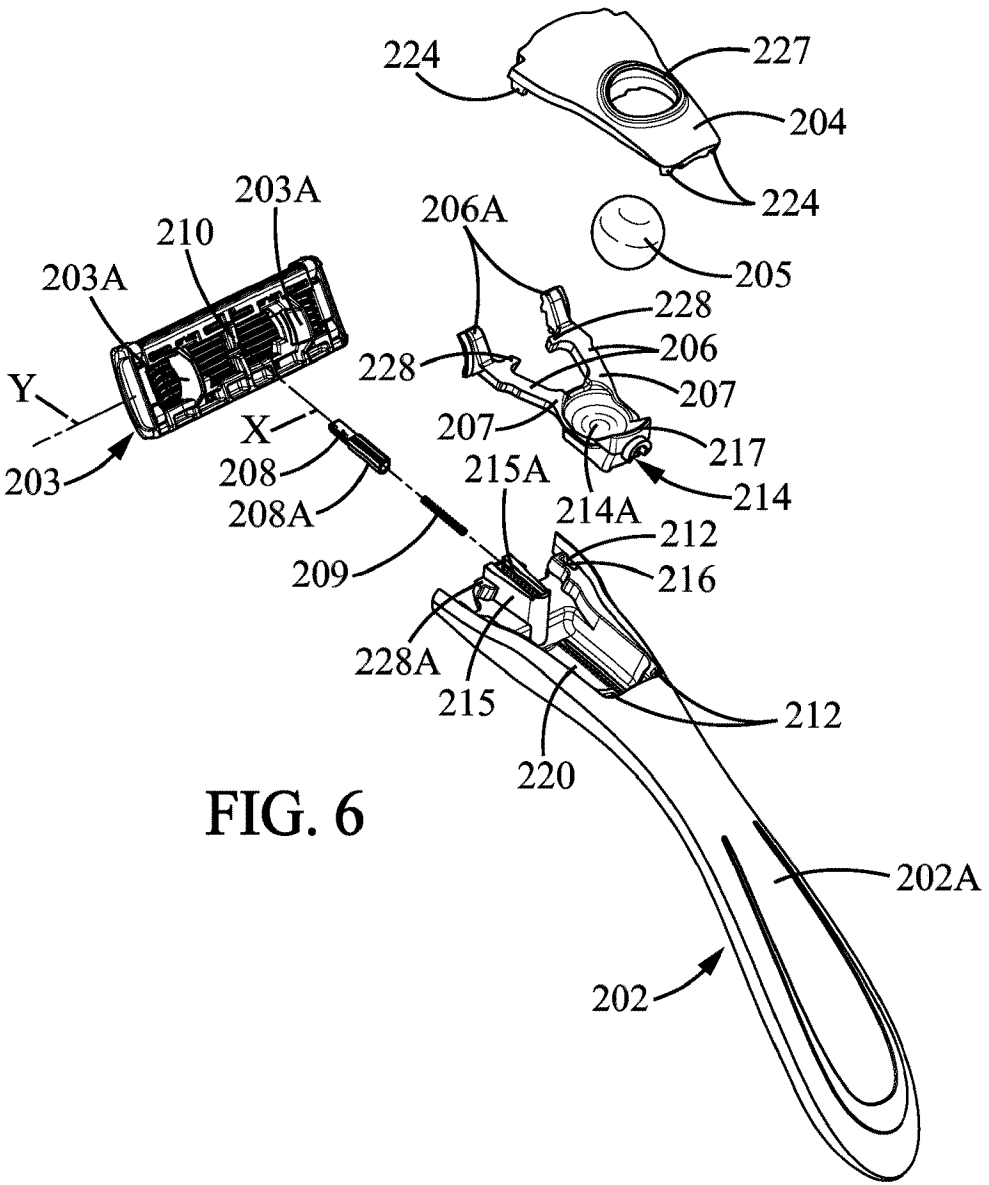
FIG. 6 shows an exploded view of the distal part of the handle according to the second embodiment of the invention.
Figure 7A:
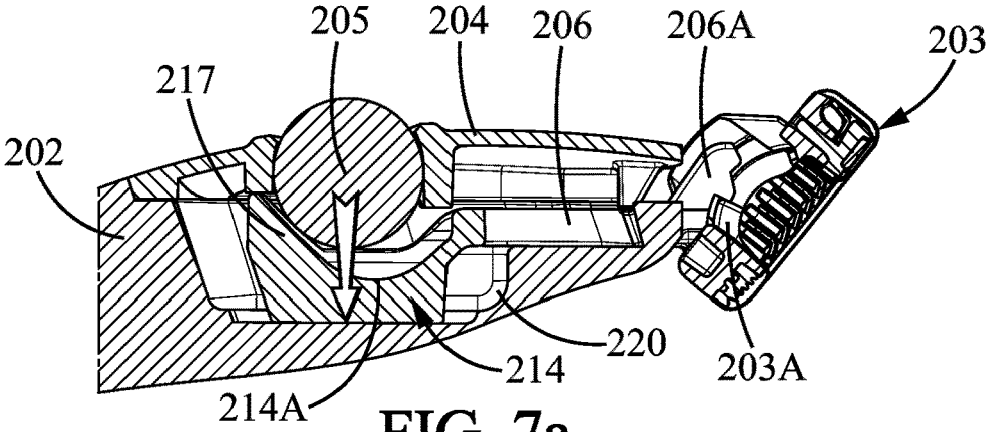
FIG. 7*a* illustrates a side section view of the distal part of the handle before actuation of the button.
Figure 7B:
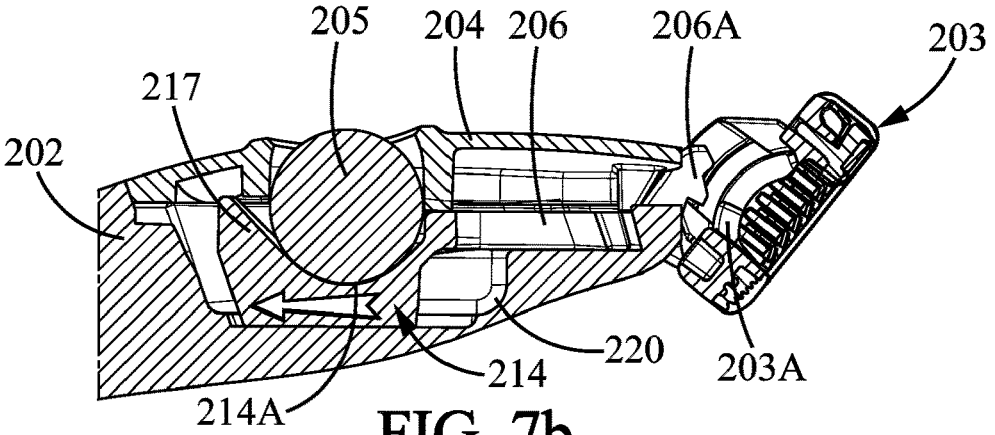
FIG. 7*b* illustrates a side section view of the distal part of the handle after the actuation of the button.

The actuation button 205 shown on FIGS. 5-6 of the accompanying drawings is movably mounted on the handle body 202A. The actuation button 205 is adapted to be movable between a lifted position and a depressed position. The actuation button 205 cooperates by means of the camming action with the pair of arms 206, such that upon actuation of the actuation button 205 into the depressed position, the arms 206 are moved closer together into the release position. The cartridge 203 is thus disengaged. When the actuation button 205 is released by the user, the pair of arms 206 is elastically biased into the rest position. Simultaneously, by means of the caroming action, the pair of arms 206 forces the actuation button 205 back into the lifted position. More detailed description of the release mechanism is provided below.

The actuation button 205 may include a substantially spherical part. The substantially spherical part may constitute any portion of a sphere, for instance a half-sphere. The substantially spherical part can be visible for a user. Alternatively, the actuation button 205 itself may have a substantially spherical shape as shown for instance on FIG. 6. The actuation button 205 may be manufactured so that it adds weight to the distal part of the handle 202. With a substantially spherical button 205 the manufacturing process of the actuation button 205, as well as the whole lock and release mechanism, is simplified, which makes the shaver assembly less costly. One advantage of a substantially spherical actuation button 205 is that the sphere is symmetrical and easy to mold. The symmetric shape also simplifies the whole manufacturing process, since there is no directional dependency when placing the sphere in the handle body 202A during an assembly of the handle 202. The substantially spherical actuation button 205 is also comfortable for a user when using the button 205 as a finger rest area.

In at least one embodiment, the two arms 206 extend substantially in a common plane XY. The button 205 is mounted in the handle body 202A, so that it can move in a direction substantially perpendicular to the plane XY. The button 205 can be restricted in motion within the plane XY by being fixed inside the hole 227 of the cover 204. Thus the button 205 is restricted in movement to the sides of the handle 202 and along the longitudinal direction of the handle 202. Additionally, the button 205 may be restricted from rotational movement. The restriction in rotational movement can be achieved for example by covering the surface of the button 205 with a suitable material, such as rubber or other elastomeric materials, increasing the friction between the button 205 and the rim of the hole 227.

The rubber or other elastomeric material may also serve as a suitable finger rest area. The actuation button 205 may thus also serve as a support area for resting user's finger during shaving. Therefore the actuation button 205 provides support for the user's finger, which is close to the blades, thus the motion of the blades on a user's skin can be led more conveniently during shaving.

In at least one embodiment, the actuation button 205 may be provided with an outer layer adapted to prevent slipping of a user's finger when rested against the button 205. Alternatively, the button 205 may be manufactured from a material which inherently restricts slippery motion when in contact with user's skin. Examples of such material preventing slippery motion are elastomeric materials, such as rubber or similar.

The material of the actuation button 205 may have different density from the density of the material of the handle body 202A. Thereby the balance of the handle 202 can be improved. The difference between the density of the actuation button 205 and the density of the handle body 202A can be at least 10% of the density of the handle body 202A.

The material of the actuation button 205 may be chosen among materials with density higher than the density of a material used for manufacture of the handle body 202A. In at least one embodiment, the button 205 is made of metal. The weight of the actuation button 205 helps to improve user's feel during shaving and to enhance shaving performance. Such a weight in the distal portion of the handle 202 makes the process of shaving more natural and convenient, especially when the handle body 202A is molded from light low-cost material, such as plastic material. The additional weight placed in the button 205 is close to the blades. Therefore the perception of the blades on user's skin during the shaving stroke might be enhanced.

It is taken into consideration that the additional weight of the actuation button 205 is lower than the elastic return force exerted by the elastic portion, for example the hinges 207, of the two arms 206. This is so as to help avoid unexpected spontaneous release of the cartridge 203 merely by the weight of the button 205 without a user actually pushing the button 205. This provision also ensures that the actuation button 205 can be moved back to the lifted position, when the arms 206 are elastically biased to the rest position.

There can be a connecting portion 214 movably mounted on the handle body 202A. The connecting portion 214 may be adapted for a sliding motion along the X-axis of the handle 202. The connecting portion 214 can be adapted to slide in a direction away from the cartridge 203.

The connecting portion 214 may further include a cavity 214A shaped so that the actuation button 205 fits into the cavity 214A when the actuation button 205 is in the depressed position. In the cavity 214A, the actuation button 205 can be seated conveniently when actuated into the depressed position. As the button 205 is pressed from the lifted position towards the depressed position inside the handle 202, it is lodged in the cavity 214A.

A pair of arms 206 can protrude outwardly from the connecting portion 214. For example, the arms 206 may protrude in a direction towards the cartridge 203. The arms 206 may extend symmetrically to the X-axis. In the rest position the arms 206 may extend such that any portion of the arms 206 located closer to the cartridge 203 is at the same or greater distance from the X-axis than the portion located further from the cartridge 203. Thus the arms 206 are diverging from the X-axis. Preferably, the pair of arms 206 and the connecting portion 214 lie in the XY plane.

The cartridge 203 can be allowed to pivot around an axis Y. The handle 202 is provided with return means adapted to return the cartridge 203 to a neutral position when the cartridge 203 is rotated. The cartridge 203 is held on the handle 202 by shell bearings 206A. The shell bearings 206A are adapted to engage with rims 203A provided on the cartridge 203. The rims 203A and the shell bearings 206A enable the cartridge 203 to rotate around the axis Y during shaving. Other pivoting means, which allow the cartridge 203 to pivot around the Y-axis, are also possible, for example pins provided on the arms 206 and the corresponding holes disposed on the cartridge 203.

In order to provide for a smooth sliding movement of the connecting portion 214 along the X-axis, there may be a depressed area 220 in the handle body 202A surrounding the connecting portion 214. The arms 206 can be directly connected to the connecting portion 214, so that the connecting portion 214 and the arms 206 slide together. In a preferred embodiment, the arms 206 and the connecting portion 214 are adapted to slide along the X-axis in a direction away from the cartridge 203. When returned back to the rest position, each of the two arms 206 may be supported by a respective rest projection 216 protruding from each side of the handle 202. In the rest position the arms 206 lean against the rest projections 216.

At least one inclined surface 217 may be provided on the connecting portion 214. For example, the at least one inclined surface 217 is located near the edge of the connecting portion 214. The at least one inclined surface 217 may be planar. The at least one inclined surface may protrude outside from the connecting portion 214 in a direction perpendicular to the XY plane. The at least one inclined surface 217 can protrude from the connecting portion 214, so that the inclined surface 217 is in contact with the actuation button 205. For example, there is at least one portion on the actuation button 205, which contacts the at least one inclined surface 217 of the connecting portion 214. In the lifted position, the button 205 is seated between the cover 204 and the at least one inclined surface 217. The at least one portion of the actuation button 205, which contacts the at least one inclined surface 217 of the connecting portion 214 may be adapted to slide along the at least one inclined surface 217 during the actuation of the button 205. For example, a substantially spherical shape of the button 205 is compatible with the at least one inclined surface 217 as displayed on FIG. 6. Alternatively, triangular shape of the at least one portion of the button 205, which contacts the at least one inclined surface 217, would be also possible.

Additionally, the handle 202 may be provided with push features 229. For example, the push features 229 may project from the rest projections 216 towards the center part of the handle 202, in a direction parallel to the Y-axis. When the arms 206 are in the rest position, the arms 206 may lean against the push features 229. The push features 229 can contact the arms 206 substantially in the middle of the length of the arms 206. The push features 229 can contact that side of the arms 206, which is further from the X-axis.

When the actuation button 205 is pressed by the user towards the depressed position, it may slide along the at least one inclined surface 217 of the connecting portion 214. As the button 205 slides along the at least one inclined surface 217, the connecting portion 214 is forced by the button 205 to slide along the X-axis. For example, the connecting portion 214 is pushed along the X-axis in a direction away from the cartridge 203 during the actuation of the button 205. Preferably, the connecting portion 214 slides within inside of the depressed area 220.

The connecting portion 214 may be attached to the pair of arms 206 by a pair of elastic connections. In at least one embodiment, when the actuation button 205 is pressed into the depressed position, the connecting portion 214 and the arm 206 slide together along the X-axis. The connecting portion 214 and the aims 206 slide in a direction away from the cartridge 203.

The push features 229 may be adapted to move the arms 206 closer together, when the arms 206 and the connecting portion 214 slide together along the X-axis. The push features 229 may thus force the arms 206 from the rest position to the release position, thereby disengaging the arms 206 from the cartridge 203. For example, in the rest position the arms 206 may extend such that any portion of the arms 206 located closer to the cartridge 203 is at the same or greater distance from the X-axis, than the portion located further from the cartridge 203. The push features 229 can be located substantially in the middle of the length of the arms 206. Therefore in the rest position, any portion of the arms 206 closer to the cartridge 203 than the push features 229, is also more distant from the X-axis, when compared to the push features 229. As the arms 206 and the connecting portion 214 slide together in a direction away from the cartridge 203, the corresponding portions of the arms 206 are forced closer together by the push features 229. Thus, the push features 229 force the arms 206 into the release position, and the cartridge 203 is released.

By means of the ramming action of the actuation button 205 to the pair of arms 206, the motion of the actuation button 205 from the lifted position into the depressed position is connected with the movement of the arms 206 from the rest position into the release position. Upon pressing the actuation button 205, the arms 206 may move close to each other, towards the release position, thereby releasing the cartridge 203 from the handle 202. The two arms 206 can be elastically biased towards the rest position by an elastic force generated by the hinges 207. When the button 205 is in the depressed position, the elastic force generated by the hinges 207 may lift the actuation button 205 back to the lifted position, when the button 206 is released by a user.

Figure 8A:
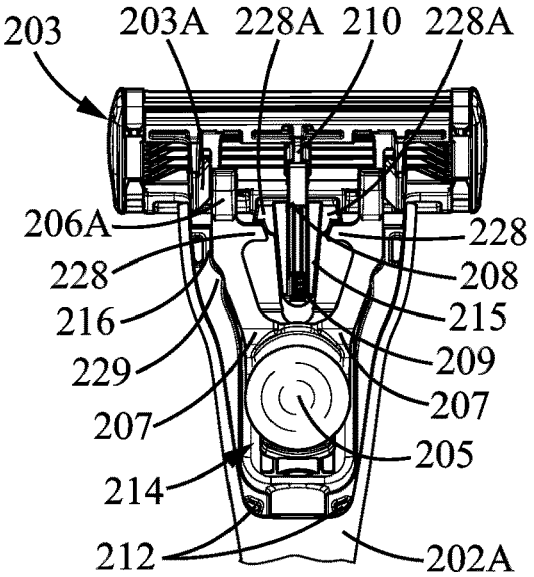
FIG. 8*a* is another view of the distal part of the handle and the lock & release mechanism before the actuation of the button.
Figure 8B:
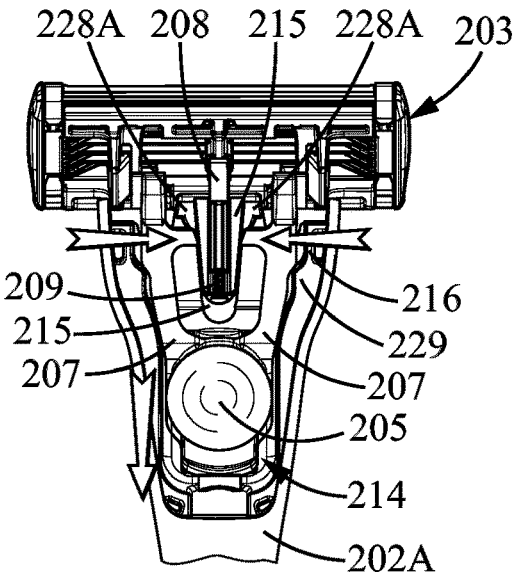
FIG. 8*b* is yet another view of the distal part of the handle after the actuation of the actuation button.
Figure 8C:
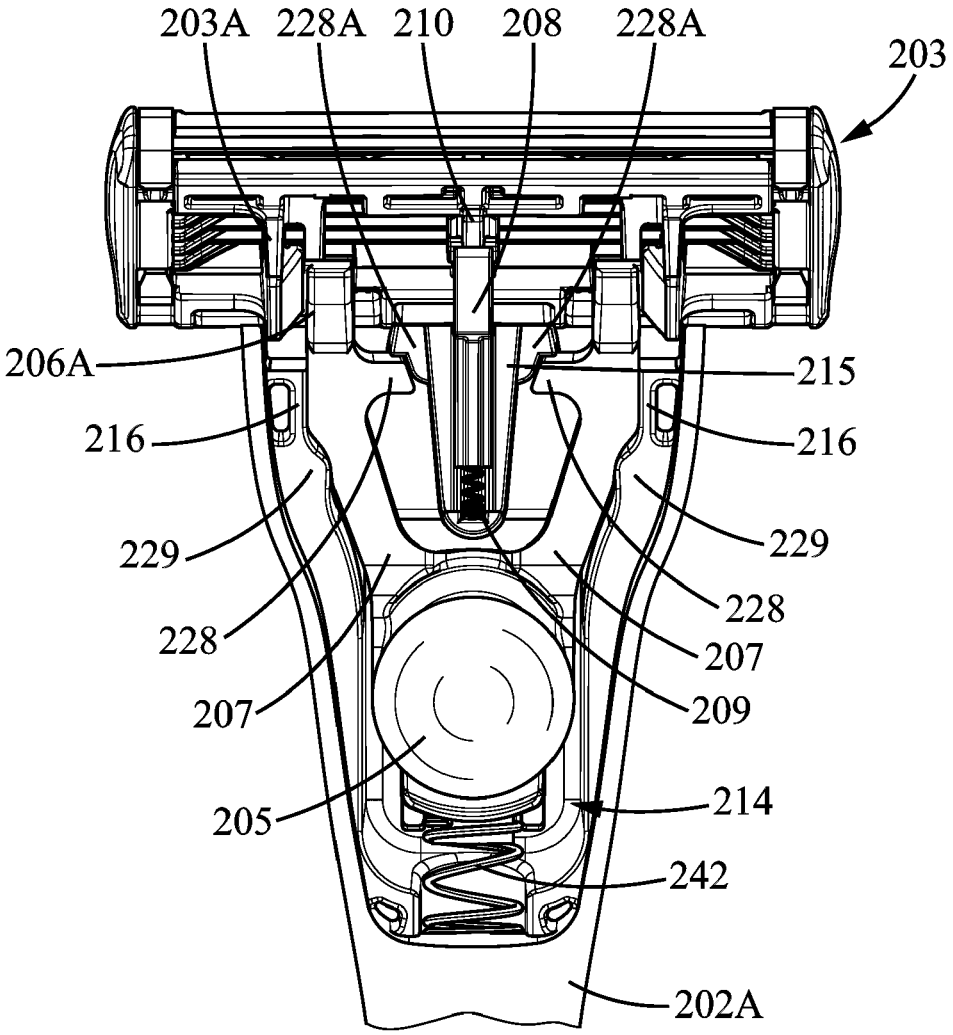
FIG. 8*c* shows a variant of the second embodiment, including an additional return spring.

Additionally, as shown in FIG. 8*c*, the handle 202 may include a spring 242 positioned near the proximal side of the connecting portion 214. More particularly, the spring 242 may be located between the proximal side of the connecting portion 214 and a corresponding adjacent wall of the depressed area 220. The spring 242 may be partially embedded into the proximal wall of the depressed area 220 neighboring the proximal side of the connecting portion 214. As the connecting portion 214 is slid away from the cartridge 203 during actuation of the actuation button 205, the connection portion presses the spring 242 against the proximal wall of the depressed area 220, thereby increasing the elastic tension within the spring 242. Therefore, the spring 242 may further support the return force generated by the hinges 207, when the actuation button 205 is about to be raised into the lifted position.

In an alternative embodiment, the pair of arms 206 may be closer together in the rest position than in the release position. For example, when the actuation button 205 is actuated the arms 206 are forced apart into the release position, thus the cartridge 203 is released.

In at least one embodiment, a guard member 215 may be provided on the handle body 202A. The guard member 215 may be molded as a part of the handle body 202A. The guard member 215 can be molded in the distal-most part of the handle 202, neighboring the cartridge 203. The guard 215 can lie on the X-axis of the handle 202.

In at least one embodiment, the guard member 215 encloses return means for returning the pivoting cartridge 203 to a neutral position. The guard member 215 might accommodate any means for returning the cartridge 203 to a neutral position known in the art. According to at least one embodiment of the present invention, the return means could be a combination of a pusher 208 and a spring 209. The spring 209 may generate the required elastic force for returning the cartridge 203 to a neutral position. The pusher 208 can cooperate with a corresponding cam surface 210 of the cartridge 203. The pusher 208 may be located inside the guard 215. The pusher 208 can be covered with the cover 204, so that the pusher 208 is restricted in movement in all the directions other than that along the X-axis. The pusher 208 can be adapted to reciprocate inside the guard 215. To this end, the pusher 208 may be provided with at least one protrusion 208A. For example, the pusher 208 includes two protrusions 208A provided on the opposite sides of the pusher 208. In at least one embodiment, one of the protrusions 208A fits inside a groove 215A provided on the inside of the guard 215. The cover 204 can also be provided with a groove, in which the other protrusion 208A is located during movement of the pusher 208.

In at least one embodiment, the arms 206 are provided with stop members 228. For example, the stop members 228 ensure that the two arms 206 do not come too close to each other when the arms 206 are moved into the release position. The stop members 228 lean against a guard member 215, as the arms 206 are closing towards each other towards the release position. The hinges 207 are thus prevented from a sudden overload, which could lead to breaking of the hinges 207. The guard member 215 and the stop members 228 prevent the hinges 207 from reaching the point of the yield or the ultimate tensile stress exerted thereon, the former being the point of maximum stress that the material can withstand before undergoing permanent plastic deformation, and the latter being the point at which the material breaks. By providing the arms 206 with the stop members 228, the arms 206 are stopped in the release position, thereby reducing the risk of the hinges 207 stretching too much and reaching the point of the yield or the ultimate tensile stress exerted thereon. By such provision the functionality and durability of the hinges 207 is improved. The probability of accidently breaking the hinges 207 by straining it too much and causing excessive deformation is reduced. The hinges 207 are thus less vulnerable to an improper or excessive use, and the reliability of the whole shaver is therefore also improved. With the protective means, such as the guard member 215 and the stop members 228, the lifetime of the shaver might increase; moreover the user's costs spent on shaving are lowered.

Therefore the guard member 215 serves as a multifunctional element. Consequently, the number of components included in the lock and release mechanism of the handle 202 is reduced, and the manufacturing process of the handle 202 is simplified.

Moreover, the stop features 228 might be adapted so that they do not allow the arms 206 to move into the release position in case the cartridge 203 is pulled out. To this end safety features 228A may be disposed on the sides of the distal part of the guard 215. The safety features 228A may protrude outwardly from the guard 215 toward the sides of the handle 202. The stop features 228 are fastened by the safety features 228A, so that the stop features 228 are prevented from movement toward the cartridge 203. Therefore, the cartridge 203 is more effectively prevented from an accidental release, and the safety of the user is increased.

In at least one embodiment, the two arms 206, the connecting portion 214, and the stop members 228 are made of plastic material. The pair of arms 206 may be directly connected to the connecting portion 214, without the presence of elastic connections. In this case, the elastic return force may be generated by the arms 206 themselves. The arms 206 may include the hinges 207 generating the return force.

As depicted in FIGS. 8*a*-8*b*, a set of openings 212 may be provided on the handle 202. The openings 212 might engage with a set of corresponding protrusions 224 (shown in FIG. 6) disposed on the cover 204. The cover 204 can be press-fitted in a set of openings 212, in order to be secured to the handle body 202A. There may also be a hole 227 in the cover 204 abutting the actuation button 205 so that the button 205 is restricted in side-to-side motion. In case the actuation button 205 has a substantially spherical shape, the hole 227 has a circular shape. The hole 227 can have a diameter smaller than the diameter of the button 205. In the illustrated embodiment, the button 205 is retained inside the handle body 202A. Furthermore, the button 205 may partially protrude outside through the hole 227 in the cover 204.

Figure 9:
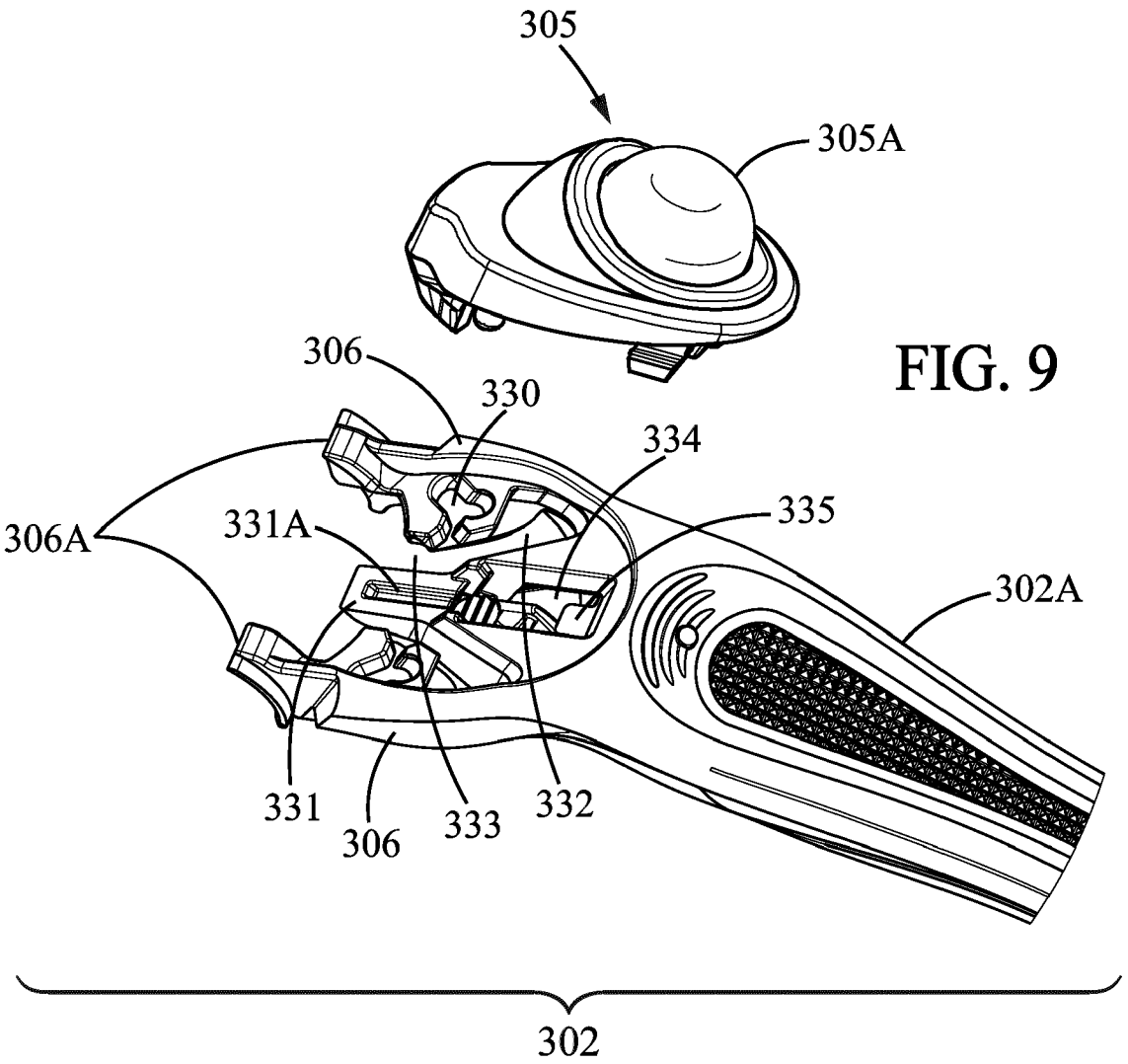
FIG. 9 depicts a shaving razor according to the third embodiment of the invention.

A shaver 301 according to another embodiment of the invention is presented on FIG. 9. The shaver 301 includes a handle 302, a cartridge 303, and an actuation button 305. The button 305 further includes a substantially spherical part 305A fixed in the button 305.

The handle 302 may include an elongated handle body 302A, which includes an elongated gripping portion. The handle body 302A may be further made of low-cost material, such as plastic material. Alternatively, the handle body 302A may be manufactured from any other suitable material, such as from metal. The handle body 302A according to the present invention preferably includes as few components as possible. The handle body 302A can be made as one piece. The handle body 302A and/or the button 305 may have at least one finger rest area. The finger rest areas may be manufactured for instance from rubber or the like.

Figure 10:
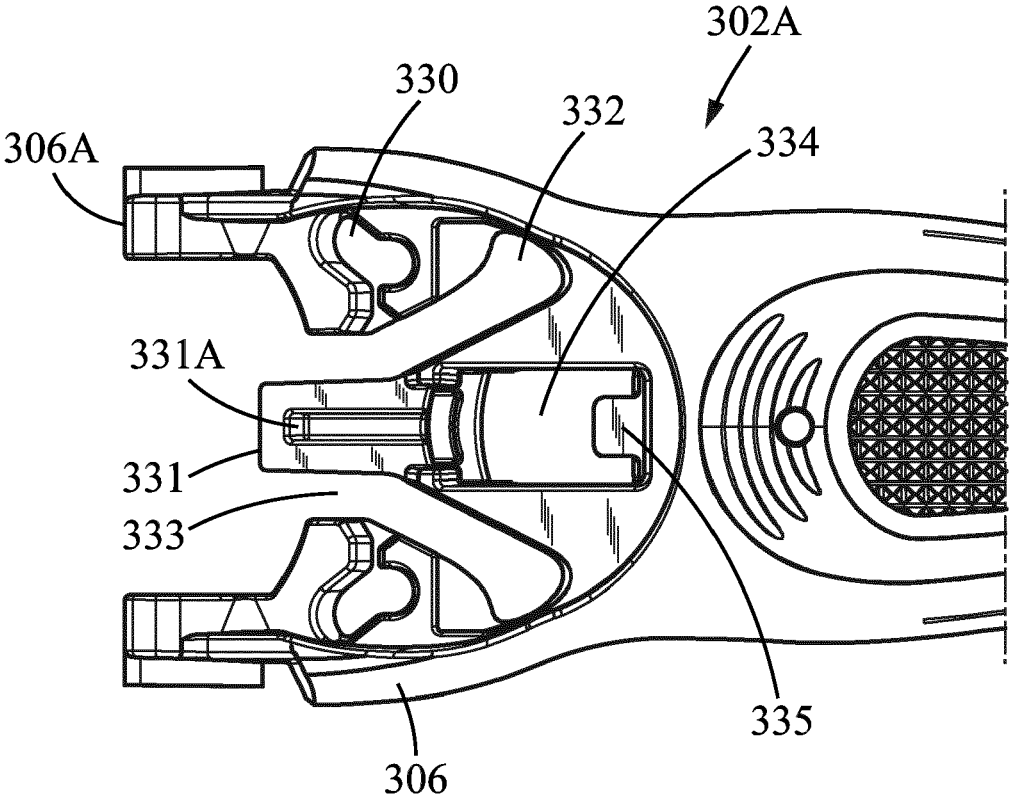
FIG. 10 shows an distal part of the handle without an actuation button according to the third embodiment of the invention.

The distal part of the handle 302 according to a third embodiment of the present invention is illustrated for example in FIG. 10. The lock and release mechanism is adapted to releasably engage and disengage the razor cartridge 303. The handle 302 is provided with an arm assembly comprising a pair of arms 306. The cartridge 303 is pivotally mounted on the pair of arms 306. The arms 306 are movable between the rest position, when the cartridge 303 is engaged on the handle 302, and the release position when the cartridge 303 is disengaged from the handle 302. As displayed on the FIG. 10, the arms 306 are provided with shell bearings 306A by means of which the cartridge 303 is mounted on the handle 302. In the rest position the shell bearings 306A are engaged with rims 303A provided on the cartridge 303. The rims 303A and the shell bearings 306A enable a rotational movement of the cartridge 303 around the pivot axis Y. Any alternative means for attaching the pivoting razor cartridge 303 might be used, such as pins and corresponding holes, or the like.

Alternatively, the arms 306 may be compatible with an intermediate structure attached to the cartridge 303. The arms 306 then might engage and disengage with the intermediate structure, or both the cartridge 303 and an intermediate structure.

The pair of arms 306 is adapted to cooperate with the actuation button 305. Upon actuation of the actuation button 305 the two arms 306 are moved closer together into the release position by way of camming action between the actuation button 305 and the pair of arms 306. Advantageously, the actuation button 305 may comprise a substantially spherical part 305A. The substantially spherical part 305A may constitute any portion of a sphere, for instance a half-sphere. The substantially spherical part 305A can be visible for a user. The substantially spherical part 305A can be positioned so that the user's finger comes in contact therewith when actuating the button 305. The manufacturing process of the substantially spherical part 305A is simpler, quicker, and with less production costs than the manufacturing process of other more complex parts. The substantially spherical shape is also comfortable for a user when using the substantially spherical part 305A as a finger rest area.

The material of the substantially spherical part 305A may have different density from the density of the material of the handle body 302A. Thereby the balance of the handle 302 can be improved. The difference between the density of the substantially spherical part 305A and the density of the handle body 302A can be at least 10% of the density of the handle body 302A.

The substantially spherical part 305A can be manufactured so that it adds weight to the distal part of the handle 302. More particularly, the substantially spherical part 305A may be manufactured from material with density higher than the density of the material used for manufacturing handle body 302A. For example, the substantially spherical part 305A may be made of metal. The actuation button 305 can thus serve multiple functions; the actuation button 305 can release the razor cartridge 303; The actuation button 305 can also provide additional weight to the distal part of the handle 302.

The substantially spherical part 305A of the actuation button 305 provided with additional weight helps to improve user's feel during shaving and to enhance shaving performance. The additional weight in the distal portion of the handle 302 makes the process of shaving more natural and convenient, especially when the handle body 302A is molded from light low-cost material, such as plastic material. The additional weight placed in the button 305 is close to the blades. Therefore the perception of the blades on user's skin during the shaving stroke might be enhanced.

The actuation button 305 and/or the substantially spherical part 305A of the actuation button 305 may serve as a support area for resting user's finger. Therefore, the button 305 and/or the substantially spherical part 305A of the button 305 may be coated with rubber or other elastomeric material to prevent slipping of a user's finger when the finger is rested against the button 305. Alternatively, the button 305 may be manufactured from a material which inherently restricts slippery motion when in contact with user's skin. Examples of such material preventing slippery motion are elastomeric materials, such as rubber or similar.

When the cartridge 303 is to be released from the handle 302, the arms 306 are flexed to be brought closer together. The cartridge 303 may thus be disengaged from the shell bearings 306A and removed or replaced. For this reason, each arm 306 includes a receptacle 330. The receptacles 330 are provided on the front surface of each respective arm 306. The receptacles 330 may be of non-linear shape. For example, the receptacles 330 may be of a substantially beam-like shape. The receptacles 330 are adapted to receive pins 337 provided on the button 305. The arms 306 can be positioned symmetrically with respect to the X-axis on the handle 302.

Between the arms 306, a platform 331 is positioned. The platform serves multiple purposes. It provides a support for the pusher 308. Further, it locks the button 305 in its position and helps to prevent disengagement of the button 305. The platform 331 can take an overall shape of a prism. The walls of the platform 331 that are adjacent to the arms 306 can be parallel to the longitudinal axis of the shaver.

The platform 331 includes a front wall, the front wall being oriented towards the button 305. The front wall of the platform includes a track 331A. The track 331A is adapted to receive one of the guiding protrusions 308A provided on the pusher 308. The track 331A then helps to guide the pusher 308 to reciprocate linearly, reducing risk of the pusher 308 being displaced or misguided in a wrong direction. Therefore, the risk of damage of the pusher 308 is lowered, and the function of the cartridge 303 returning to its rest position is enhanced.

The arms 306 and the platform 331 are separated from each other by non-linear slots 332. The non-linear slots 332 are provided between the platform 331 and each respective arm 306. Each of the non-linear slots 332 includes a portion defining a linear part 333. The linear part 333 is adapted to cooperate with the button 305, namely with locators 338 provided on the portion of the button 305 that mates with distal part of the handle body 302A.

Below the platform 331 a slot 334 is formed. The slot is of substantially rectangular shape. The slot 334 may be elongated in one direction. The direction of the slot can be parallel to the longitudinal axis of the shaver 301. The walls of the slot 334 parallel to the longitudinal axis of the shaver 301 can be parallel to each other, and also to the side walls of the platform 331. The side walls of the slot 334 may be provided substantially in one line with the side walls of the platform 331. The side walls form two longitudinal edges forming a pair of opposed tracks. The tracks are adapted to receive flexible hooks 339 of the button 305.

The proximal wall of the slot 334 may include a stop projection 335. The stop projection 335 protrudes into the slot 334. The front wall of the stop projection 335 can be aligned with the front wall of the platform 331. In this way, the stop projection 334 does not interfere with the possible movements of the pusher 308. The stop projection 335 prevents flexible hooks 339 of the button 305 from being brought either closer together, or, in an alternative embodiment, further apart. The stop projection 335 thus helps to prevent the disengagement of the button 305, and disassembly of the handle 302, when the handle 302 is dropped or exposed to shock.

Figure 11:
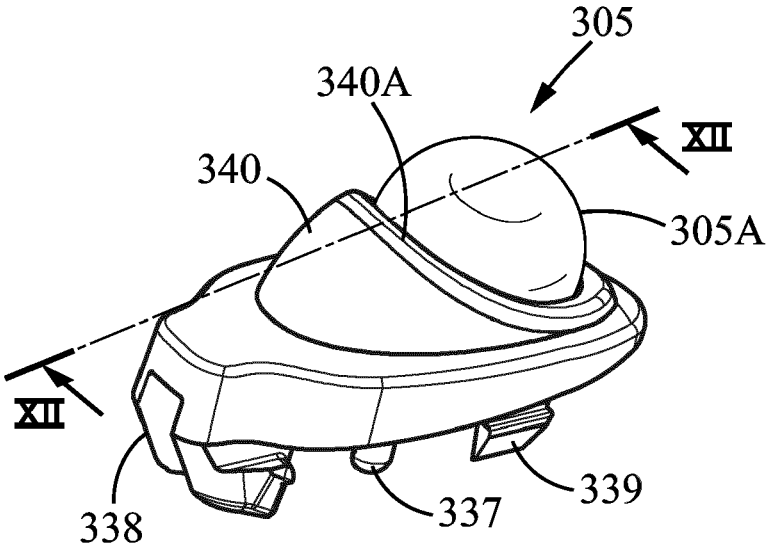
FIG. 11 displays the main components of an actuation button of the third embodiment.
Figure 12:
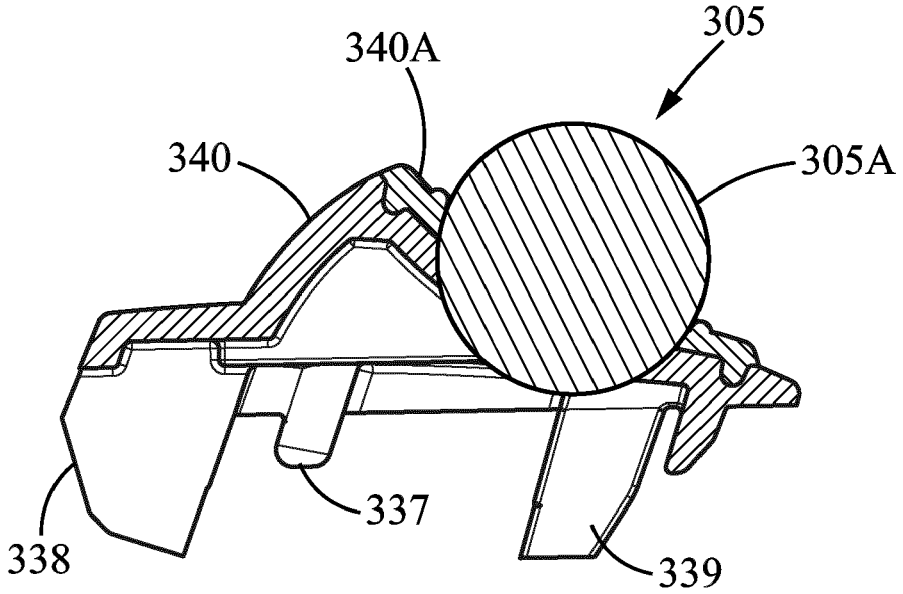
FIG. 12 is a side section view of the actuation button according to the third embodiment of the invention.
Figure 13:
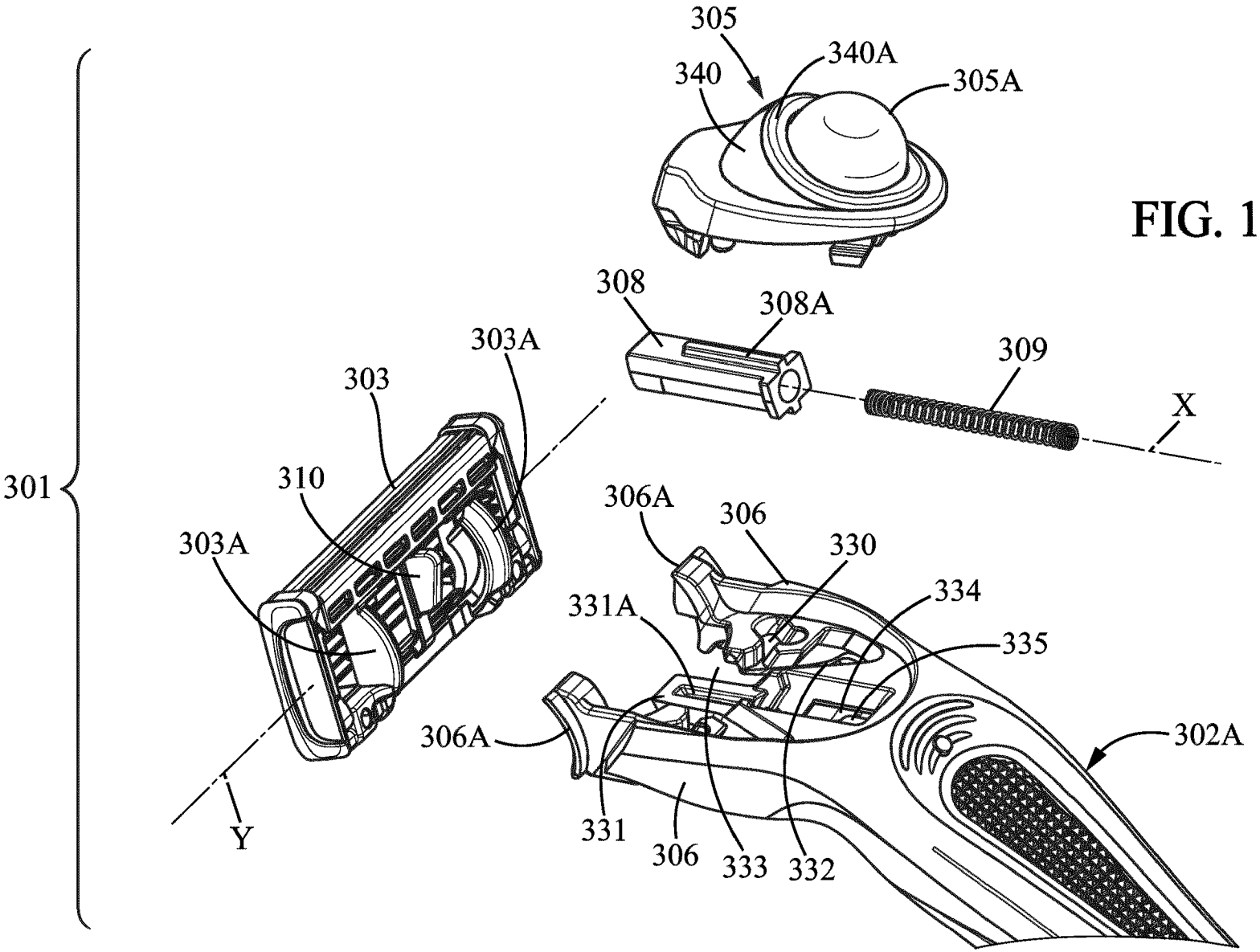
FIG. 13 shows an exploded view of the distal part of the shaving razor according to the third embodiment.

The front portion of the distal part of the handle body 302A is adapted to receive the release button 305. For example, details of such a button are shown on FIG. 11. The button 305 can be formed as a body with a protruding part 340. The protruding part 340 protrudes from the far side of the button 305 with respect to the distal front portion of the handle body 302A, and away from the handle body 302A. The protruding part 340 is adapted to accommodate the substantially spherical part 305A. The substantially spherical part 305A is adapted to contact the user's finger, when the button 305 is being actuated. To this end, the protruding part may be provided with a finger rest portion 340A. The finger rest portion 340A prevents slipping motion between the button 305 and the user's finger as the button 305 is actuated by the user, therefore enabling a smooth control of the release mechanism. The finger rest portion 340A can be made from suitable elastomeric material, such as rubber, silicone or the like. Similarly, the outer surface of the substantially spherical part 305A may also be provided with a finger rest portion. For example, the substantially spherical part 305A may be coated with suitable elastomeric material such as rubber.

Figure 14:
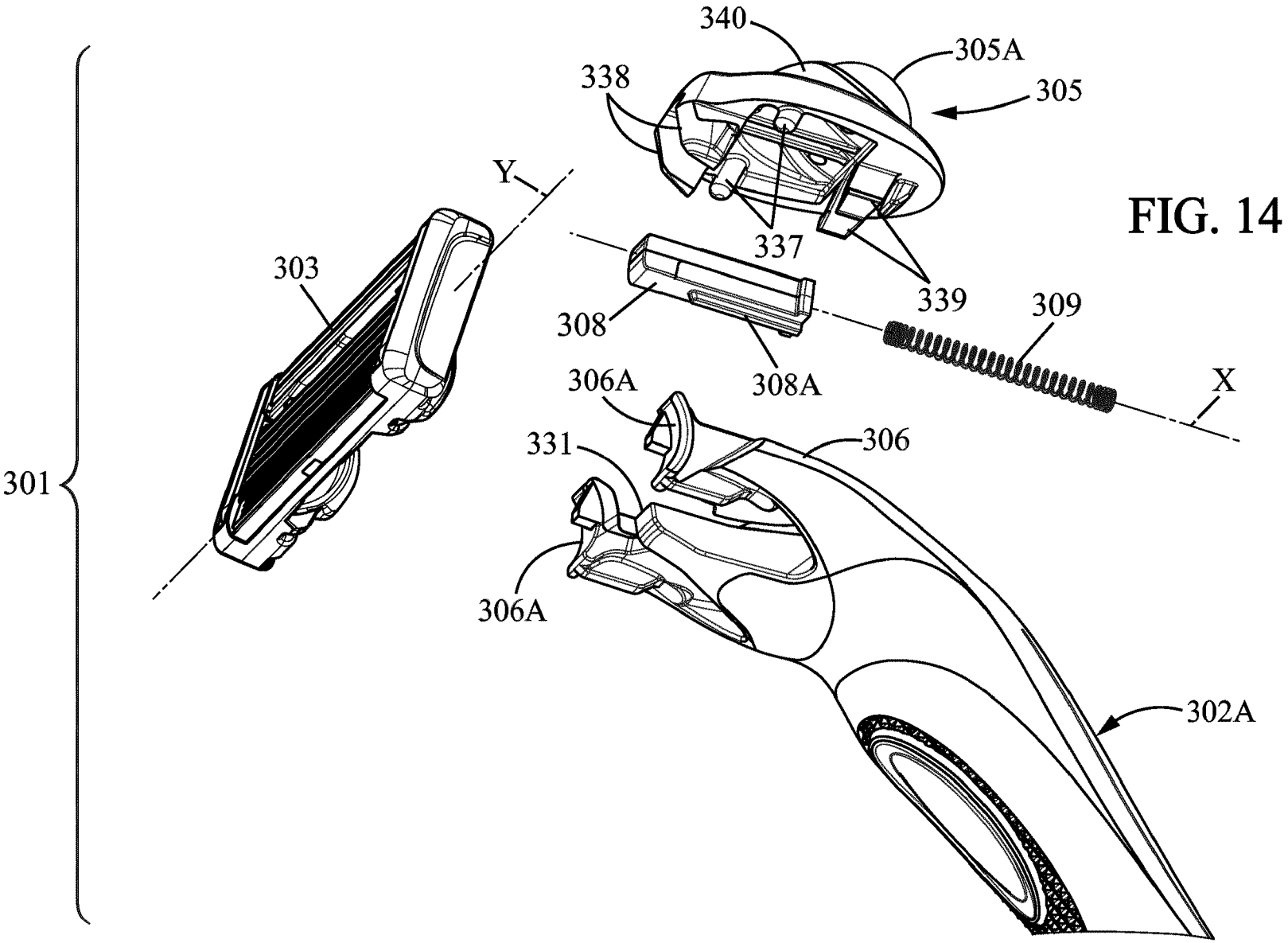
FIG. 14 depicts another exploded view of the distal part of the shaving razor according to the third embodiment from another perspective.
Figure 15:
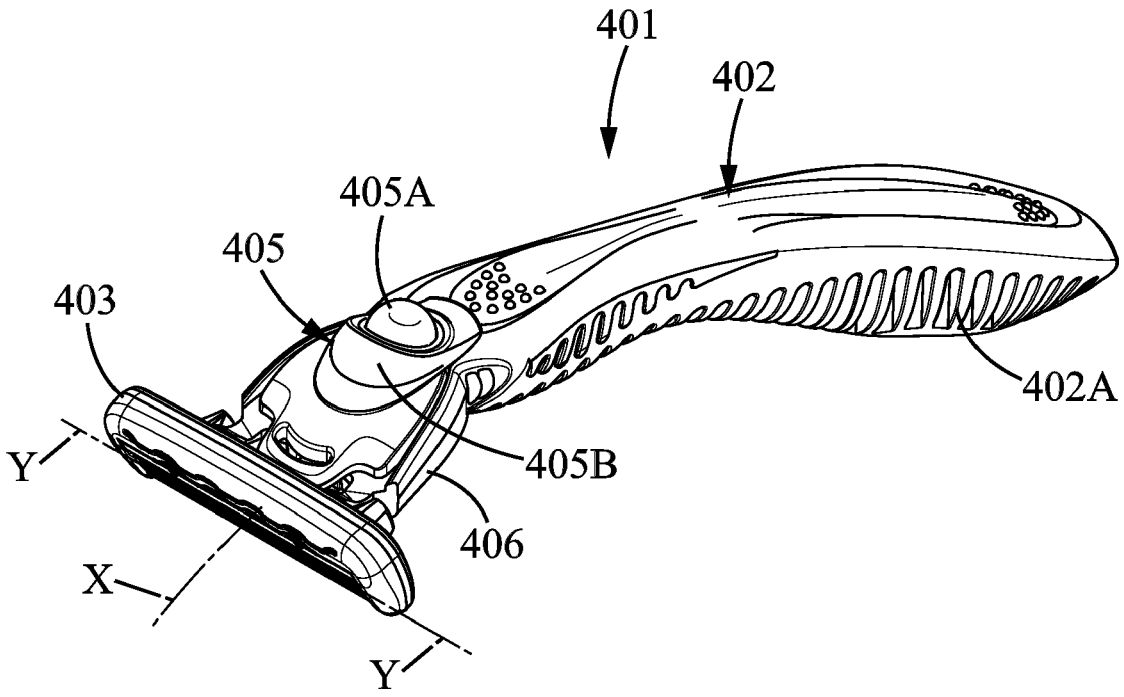
FIG. 15 illustrates a shaving razor according to the fourth embodiment of the invention.

When the cartridge 303 is to be removed, the button 305 is pushed forward toward the cartridge 303 substantially along the longitudinal direction of the handle 302. The back portion of the button 305, which can be seen in FIG. 14, includes a pair of lockers 338. The lockers 338 protrude outward from the side of the button 305 Which engages with the handle body 302A. The lockers 338 can be positioned on a side of the button 305 closer to the cartridge 303, i.e. on the distal-most part of the button 305. The lockers are positioned symmetrically with respect to the longitudinal axis of the shaver 301. The lockers 338 can be offset so as to enable the platform 331 to be positioned between them. This prevents the lockers 338 to be accidentally brought closer together, and thus damaged or disengaged from the handle body 302A.

The platform 331 and the lockers 338 define an opening through which the pusher 308 protrudes. The pusher 308 is configured to reciprocate in this opening. One of the protrusions 308A provided on the pusher 308 engages with the track 331A of the platform 331. A similar track to the one illustrated on the platform 331 may be provided also on the side of the button 305 which engages the handle body 302A. As a result, the pusher 308 is provided guidance so that the function of the pusher 308 is secured.

The pusher 308 cooperates with a spring 309. The cooperation of these two components provides a return means for returning the pivoting cartridge 303 to a neutral position when the cartridge 303 is in use and rotated. The spring 309 may also provide a pushing force for pushing the cartridge 303 away from the shell bearings 306A after the cartridge 303 is disengaged from the handle 302.

Each of the lockers 338 is provided in a form of an outwardly oriented hook. When the button 305 is in the rest position, the lockers 338 engage the linear part 333 of the non-linear slot 332.

The inner portion of the button 305, which is in contact with the handle body 302A, includes a pair of pins 337. The pins 337 can be positioned so as to engage the receptacles 330, provided in the arms 306. The receptacles 330 may be in a form of grooves, which can be non-rectilinear and may be oriented slantwise, outwardly forwardly.

The pins provide means for moving the arms 306 closer together when the cartridge 303 is to be disengaged. When the button 305 is actuated by the user, it slides along the longitudinal direction of the handle 302 towards the cartridge 303. The pins 337 move forward in the receptacles 330, thus forcing the arms 306 to flex and move closer together. Each shell bearing 306A thus disengage from the corresponding rim 303A of the cartridge 303. At the same time, the cartridge 303 may be urged away from the shell bearing 306A by the pusher 308. Therefore the cartridge 303 is removed from the handle 302 and can be replaced with a new one.

The inner portion of the button 305 further includes flexible hooks 339. The flexible hooks 339 can be provided near the proximal end of the button 305, i.e. on the end more distant from the cartridge 303. The flexible hooks 339 protrude outwardly from that side of the button 305 which engages with the handle body 302A. When the lock and release mechanism is assembled, the flexible hooks 339 extend through the slot 334 provided next to the platform 331. The flexible hooks 339 take an overall shape of a hook, with the bent portion being positioned on the distant portion of the flexible hooks 339. The hooks forming the inner part of the flexible hooks 339 can be outwardly oriented, i.e. bent outward. Thus, the flexible hooks are opposed. The flexible hooks can engage the side walls of the slot 334. The hooks are then held by the end of the side walls of the slot 334. The flexible hooks 339 can be snap-fitted with the tracks. These features prevent the button 305 from easy disengagement.

The shaver 401 of a fourth embodiment of the present invention includes a handle 402, a cartridge 403, and an actuation button 405.

The handle 402 includes a handle body 402A, which may serve as a gripping area. The handle body 402A may be further made of low-cost material, such as plastic material. Alternatively, the handle body 402A may be manufactured from any other suitable material, such as metal. The handle body 402A can include as little components as possible. The handle body 402A can be made as one piece. The handle body 402A and/or the button body 405B and/or the substantially spherical part 405A may include at least one finger rest area. The finger rest areas may be manufactured for instance from rubber or the like. The handle body 402A may be elongated, comprising an elongated gripping portion.

The actuation button 405 further includes a button body 405B and a substantially spherical part 405A. The substantially spherical part 405A may be located substantially in the middle of the button body 405B. The button body 405B and the substantially spherical part 405A may be manufactured as two separate pieces. The button body 405B may be mounted on the handle body 402A so that the button body 405B slides substantially along the longitudinal direction of the handle 402. The button body 405B can be slidably mounted on the handle body 402 along the X-axis between a first position and a second position. In the first position, the button body 405B is at the furthest point from the cartridge 403. In the second position, the button body 405B is at closest point to the cartridge 403.

The substantially spherical part 405A may be movable within the button body 405B. For example, the substantially spherical part 405A is mounted on the handle body 402, so that it can move in a direction substantially perpendicular to the plane XY. The substantially spherical part 405A may be movable between a lifted position, when the substantially spherical part 405A partially protrudes outside the button body 405B, and a depressed position when the substantially spherical part 405A is fully depressed in the inside of the button body 405B.

The material of the substantially spherical part 405A may have different density from the density of the material of the handle body 402A. Thereby the balance of the handle 402 can be improved. The difference between the density of the substantially spherical part 405A and the density of the handle body 402A can be at least 10% of the density of the handle body 402A.

The substantially spherical part 405A of the button 405 may be manufactured so that it adds weight to the distal part of the handle 402. Therefore, the substantially spherical part 405A may be made of material with density higher than the density of material used for manufacturing the handle body 402. Such additional weight of the substantially spherical part 405A helps to improve user's feel during shaving and to enhance shaving performance. The additional weight in the distal portion of the handle 402 makes the process of shaving more natural and convenient, especially when the handle body 402A is molded from light low-cost material, such as plastic material. The additional weight placed in the button body 405B is close to the blades. Therefore the perception of the blades on user's skin during the shaving stroke might be enhanced. The substantially spherical part 405A could be made from metal. Alternatively, the substantially spherical part 405A might be made from metallic alloy.

The substantially spherical part 405A may prevent the button body 405B from sliding along the longitudinal direction of the handle 402, when the substantially spherical part 405A is in the lifted position. Thus the substantially spherical part can lock the button body 405B in the first position. The substantially spherical part cooperates with the button body 405B so as to enable the button body 405B to slide toward the second position, when the substantially spherical part 405A is in the depressed position.

The advantage of the button body 405B being locked in the first position, while the substantially spherical part 405A is in the lifted position, is the possibility to use the button body 405B as a finger rest area even more comfortably during shaving. The user is advantageously allowed to place his finger in a close proximity to the blades, so that he/she can lead the shaving blades more effectively. According to the present invention, the only way to disengage the cartridge 403 from the handle 402 is to unlock the button body 405B by pressing the substantially spherical part 405A in a direction substantially perpendicular to the XY plane. The advantage of such configuration is that the user can apply almost any force desirable when resting his/her on the actuation button 405 in a direction of X-axis, when pushing the shaver 401 towards his/her skin. Therefore, by locking the button body 405B in a first position, the user's safety is even further increased. The actuation button 405 may provide support for the user's finger, which is close to the blades, thus the motion of the blades on a user's skin can be led more conveniently during shaving.

The substantially spherical part 405A can thus serve multiple functions. It might operate as a locking mechanism with respect to the sliding of the button body 405B. It may also provide additional weight to the distal part of the handle 402.

The substantially spherical part 405A could be a sphere. The spherical shape provides directional independence and allows for arbitrary placement in the handle body 402A during the manufacturing process. The manufacturing process of the substantially spherical part 405A may thus be simpler, quicker and with less production costs then the manufacturing process of other more complex parts. The spherical shape is also comfortable for a user when using the substantially spherical part 405A as a finger rest area.

The button body 405B and/or the substantially spherical part 405A in the lifted position may serve as a support area for resting user's finger, for example during shaving. Therefore, the button body 405B and/or the substantially spherical part 405A may be coated with rubber or other elastomeric material to prevent slipping of a user's finger when the finger is rested against the button body 405B and/or the substantially spherical part 405A. Alternatively, the button body 405B and/or the substantially spherical part 405A may be manufactured from a material which inherently restricts slippery motion when in contact with user's skin. Examples of such material preventing slippery motion are elastomeric materials, such as rubber or similar.

The button body 405B may be provided with an extended portion 444. The extended portion 444 may enlarge the area, which might serve for resting user's finger. With the extended portion 444, placing of the user's finger on the surface of the button body 405B may become more comfortable for the user. The extended portion 444 can be covered with a suitable elastomeric material, such as rubber or the like.

The distal part of the handle 402 according to the fourth embodiment of the present invention is illustrated in FIGS. 16-19. The lock and release mechanism is adapted to releasably engage and disengage a razor cartridge 403. The handle 402 is provided with an arm assembly including a pair of arms 406. The arms 406 can be positioned symmetrically with respect to the X-axis on the handle body 402A. The cartridge 403 may be pivotally mounted on the pair of arms 406. The arms 406 may be flexible. The arms 406 may be manufactured from any suitable elastic material, such as plastic. The arms 406 can be molded integrally with the handle body 402A.

The arms 406 are movable between the rest position, when the cartridge 403 is engaged on the handle 402, and the release position when the cartridge 403 is disengaged from the handle 402. Upon moving from the rest position toward the release position during the release of the cartridge 403, the arms 406 may move closer to each other. In other embodiments, the arms 406 can move further apart during the disengagement of the cartridge 403.

When the arms 406 are moved closer together towards the release position, the arms 406 may generate an elastic return force, which forces the arms 406 back into the rest position. The arms 406 may thus be elastically biased toward the rest position, when the button 405 is actuated. After the button 405 is released by the user, the button 405 may be pushed back into the first position by the biasing force generated by the pair of arms 406. The arms 406 and the corresponding features of the button 405 may be constructed for example as described in WO2010/037418A1.

Figure 19:
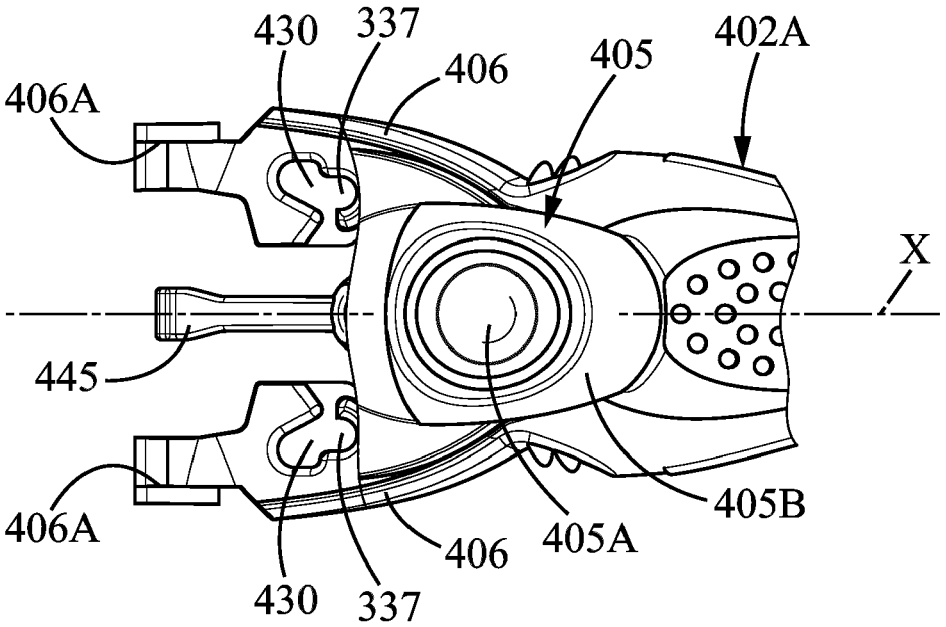
FIG. 19 is a front view of the distal part of the handle according to the fourth embodiment.
Figure 20:
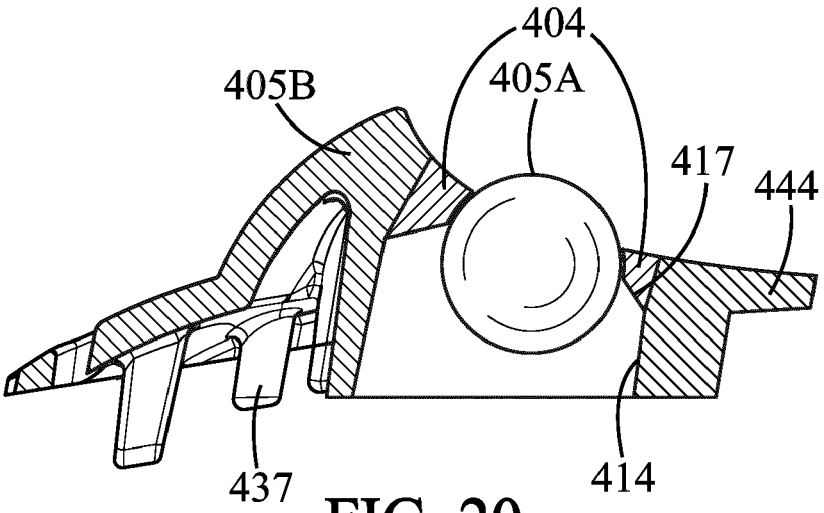
FIG. 20 is a side view of the actuation button according to the fourth embodiment.

As displayed on FIG. 19, the arms 406 may be provided with shell bearings 406A by means of which the cartridge 403 is mounted on the handle 402. For example, in the rest position the shell bearings 406A are engaged with corresponding rims (not shown) provided on the cartridge 403. The rims and the shell bearings 406A enable a pivotal movement of the cartridge 403 around the pivot axis Y. Any alternative means for attaching the pivoting razor cartridge 403 might be used, such as pins and corresponding holes, or the like.

Alternatively, the arms 406 may be compatible with an intermediate structure attached to the cartridge 403. The arms 406 then may engage and disengage with the intermediate structure, or both the cartridge 403 and an intermediate structure.

In at least one embodiment, the pair of arms 406 is adapted to cooperate with the actuation button 405. Upon actuation of the actuation button 405 the two arms 406 are moved closer together by way of camming action between the actuation button 405 and the pair of arms 406. As the button body 405B is slid forward along the X-axis from the first position to the second position toward the shaver's cartridge 403, the pair of arms 406 move closer together from the rest position towards the release position.

Each arm 406 includes a receptacle 430. The receptacles 430 are provided on the front surface of each respective arm 406. The receptacles 430 may be of non-linear shape. For example, the receptacles 430 may be of a substantially bean-like shape. The receptacles 430 are preferably leaning away from one another from proximal to the distal part of the handle 402 with respect to the longitudinal direction given by the X-axis. The receptacles 430 may be in a form of grooves, which can be non-rectilinear and may be oriented slantwise, outwardly forwardly. The receptacles 430 are adapted to receive pins 437 provided on the button body 405B. The receptacles 430 can be configured such that when the button body 405B moves forward into the second position, the arms 406 tend to move closer to each other, whereas when the button 405 returns back in its first position, the pair of arms 406 deviates back apart.

The lower portion of the button body 405B includes a pair of pins 437. When the cartridge 403 is to be released from the handle 402, the arms 406 are flexed to be brought closer together. The pins 437 provide means for moving the arms 406 closer together when the cartridge 403 is to be disengaged. The pins 437 can be positioned so as to engage the receptacles 430, provided in the arms 406. The cartridge 403 may thus be disengaged from the shell bearings 406A and removed or replaced. The pins 437 engage the receptacles 430 to drive the arms 406. The pins 437 drive the receptacles 430 to flex the arms 406 when the button body 405B is pushed from the first into the second position. When the button 405 is actuated by the user, the button body 405B slides along the X-axis towards the cartridge 403. The pins 437 move forward in the receptacles 430, thus forcing the arms 406 to flex and move closer together. Each shell bearing 406A thus disengages from the cartridge 403. Therefore the cartridge 403 is removed from the handle 402 and can be replaced with a new one.

Between the arms 406, an elastic tongue 445 may be positioned. The elastic tongue 445 may return the cartridge 403 to a neutral position, when the cartridge 403 pivots around the Y-axis. The elastic tongue 445 can be located on or parallel to the X-axis. Alternatively, the elastic tongue 445 may be replaced by any other return force generating means, such as plunger or the like.

The button body 405B may have a cavity 414, which is open toward the handle body 402A. The substantially spherical part 405A is located substantially inside the cavity 414. The cavity 414 may be dimensioned so that the substantially spherical part 405A can enter entirely in the cavity 414, as the substantially spherical part 405A is in the depressed position. The button body 405B may further include a cover 404 partially covering the cavity 414 opposite to the handle body 402A. In the lifted position the substantially spherical part 405A may partially protrude upwardly outside the button body 405B through a through hole 427. The through hole 427 is disposed in the cover 404 of the button body 405B. The through hole 427 is adapted to prevent the substantially spherical part 405A from escaping the cavity 414 of the button body 405B. When located in the through hole 427, the substantially spherical part 405A can be restricted from side-to-side movement. For example, the through hole 427 may have substantially circular cross section with diameter smaller than the diameter of the substantially spherical part 405A.

The handle body 402A includes a guide 443 extending rigidly in the cavity 414 of the button body 405B toward the cover 404. The guide 443 may take form of a wall or a post integral with the handle body 402A. The substantially spherical part 405A may bear against the guide 443 toward the arm assembly. The substantially spherical part 405A can bear against the guide 443 all the way from the lifted position to the depressed position, so that the substantially spherical part 405A is guided toward the inside of the button body 405B. Thus the substantially spherical part is guide relative to the handle body 402A substantially perpendicular to the longitudinal direction of the handle between the lifted position and the depressed position.

The handle body 402 further may include a recessed portion 450 hollowed substantially under the cavity 414 of the button body 405B. The recessed portion 450 may be designed to allow at least partial entering of the substantially spherical component 405A, as the substantially spherical part 405A is pressed in the depressed position. For example, the recessed portion 450 may be concave, so that the substantially spherical part fits in the recessed portion 450. Moreover, there might be a spring 442 disposed within the recessed portion 450. The spring 442 can be positioned between the substantially spherical part 405A and the handle body 402A. The spring 442 facilitates application of biasing force, which pushes the substantially spherical part 405A back from the depressed position to the lifted position. If no pressure is applied to the substantially spherical part 405A by a user, the force provided by the return spring 442 may keep the substantially spherical part 405A in the lifted position. Alternatively, the spring 442 may be replaced with a leaf spring or other means providing the return force.

Figure 16:
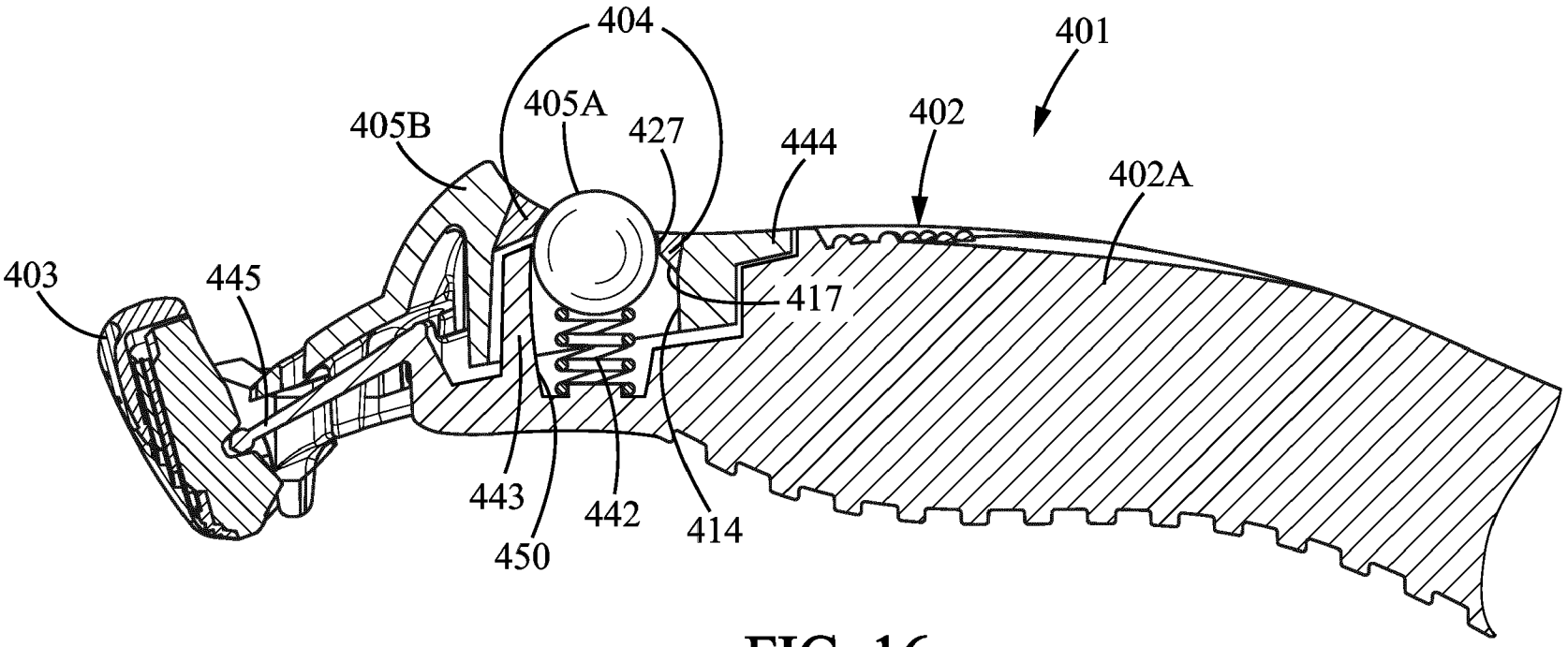
FIG. 16 shows a side section view of the distal part of the shaving razor of the fourth embodiment with a substantially spherical part in the lifted position.

FIG. 16 shows the distal part of the handle 402 with the substantially spherical part 405A in the lifted position. With the substantially spherical part 405A in the lifted position, the button body 405B is in the first position and the arms 406 are in the rest position. In the lifted position, the substantially spherical part 405A bears against the guide 443 toward the arm assembly. Furthermore, in the lifted position the substantially spherical part is fixed inside the through hole 427 of the cover 404 with respect to the longitudinal direction of the handle. Therefore, in the lifted position the substantially spherical part 405A prevents the button body 405A from sliding. The button body 405B is thus locked by the substantially spherical part 405A in the first position. Upon pressing the substantially spherical part 405A, the user can initiate movement of the substantially spherical part 405A toward the depressed position.

Figure 17:
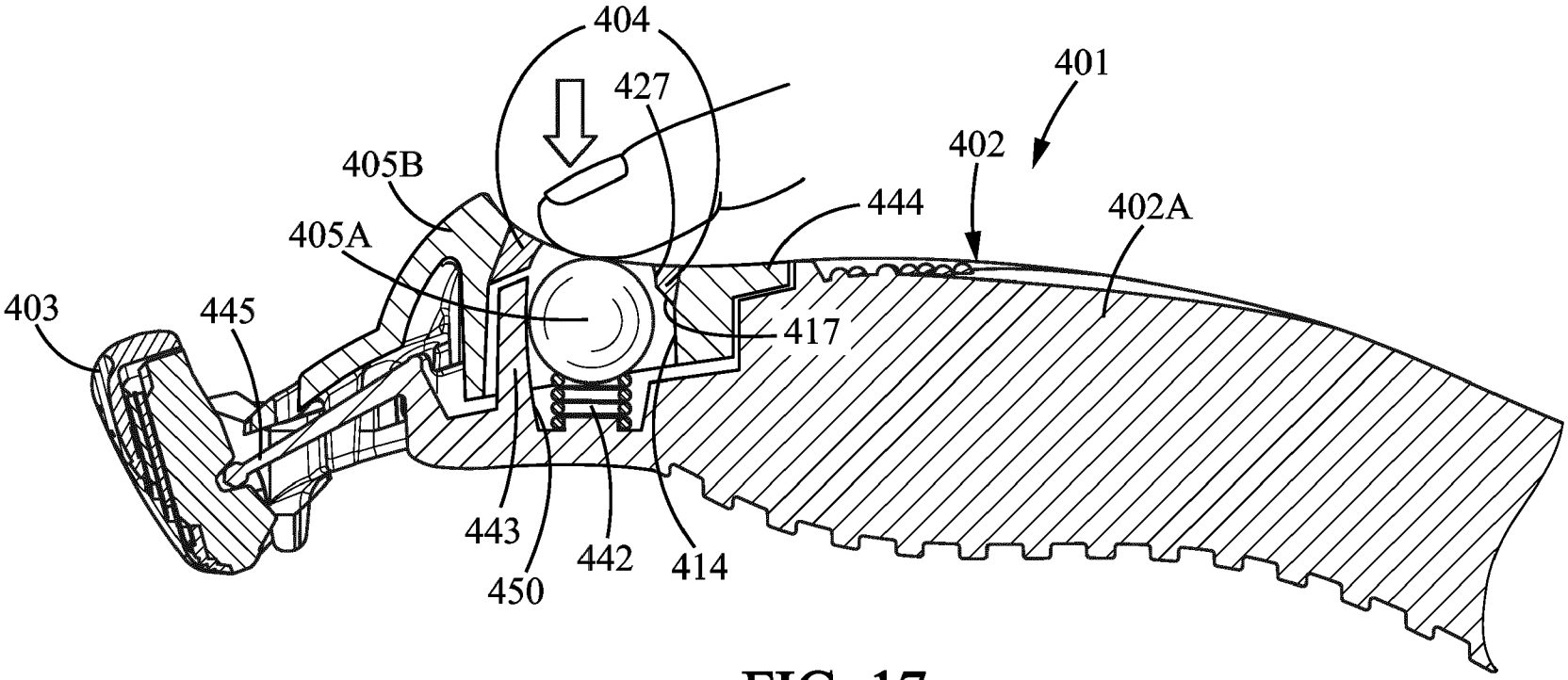
FIG. 17 shows a side section view of the distal part of the shaving razor of the fourth embodiment with a substantially spherical part in the middle position.

FIG. 17 shows the distal part of the handle 402 with the substantially spherical part 405A in a middle position, which corresponds to the substantially spherical part 405A to be substantially halfway between the lifted position and the depressed position. With the substantially spherical part 405A in the middle position, the inclined surface 417 of the button body 405B is enabled to slide along the substantially spherical part 405A. Consequently, the button body 405B is freed to slide to the second position. The user can thus push the button body 405B forward along the X-axis toward the second position. By the camming action the button body 405B starts cooperating with the arms 406, so that the arms

406 start moving to be flexed closer together toward the release position. As the button body 405B is slid forward into the second position and the substantially spherical part 405A slides along the inclined surface 417, the substantially spherical part is pressed by the inclined surface 417 of the button body 405B into the depressed position. Since the substantially spherical part 405A bears against the guide 443, the substantially spherical part 405A cannot move forward in a direction toward the arm assembly, as the substantially spherical part 405A slides along the inclined surface 417.

Figure 18:
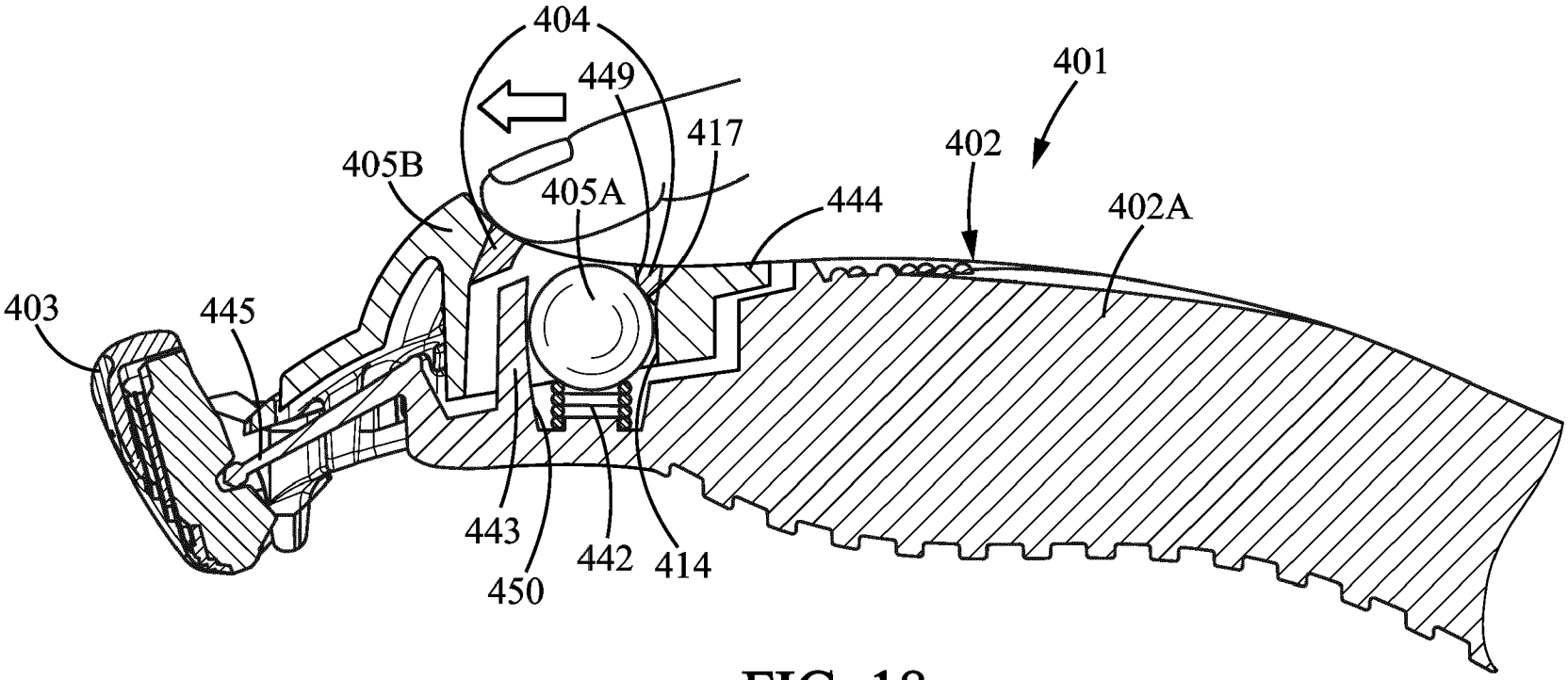
FIG. 18 shows a side section view of the distal part of the shaving razor of the fourth embodiment with a substantially spherical part in the depressed position.

FIG. 18 shows the distal part of the handle 402 with the substantially spherical part 405A in the depressed position. With the substantially spherical part 405A in the depressed position, the button body 405B is in the second position and the arms 406 are in the release position, so that the cartridge 403 can be removed/replaced. In the depressed position, the substantially spherical part 405A is pressed inside the cavity 414 of the button body 405B. Also the substantially spherical part 405A still bears against the guide 443. For these reasons, the button body 405B cannot slide any further toward the arm assembly. In the depressed position, the substantially spherical part can enter the recessed portion 450. With the substantially spherical part 405A in the depressed position, the spring 442 is fully pressed inside the recessed portion between the substantially spherical part 405A and the handle body 402A.

Once the user stops pushing the button body 405B forward, the button body 405B can be forced all the way back into the first position by means of the return force generated by the elastic arms 406. Additionally, by means of the camming action between spring 442, the substantially spherical part 405A, and the button body 405B, the return force generated by the spring 442 may contribute to pushing the button body 405B back to the first position. As the substantially spherical part 405A returns to the lifted position, the substantially spherical part 405A is guided along the guide and slides back along the inclined surface 417. Therefore, the substantially spherical part 405A forces the button body 405B back to the first position.

Figure 21:
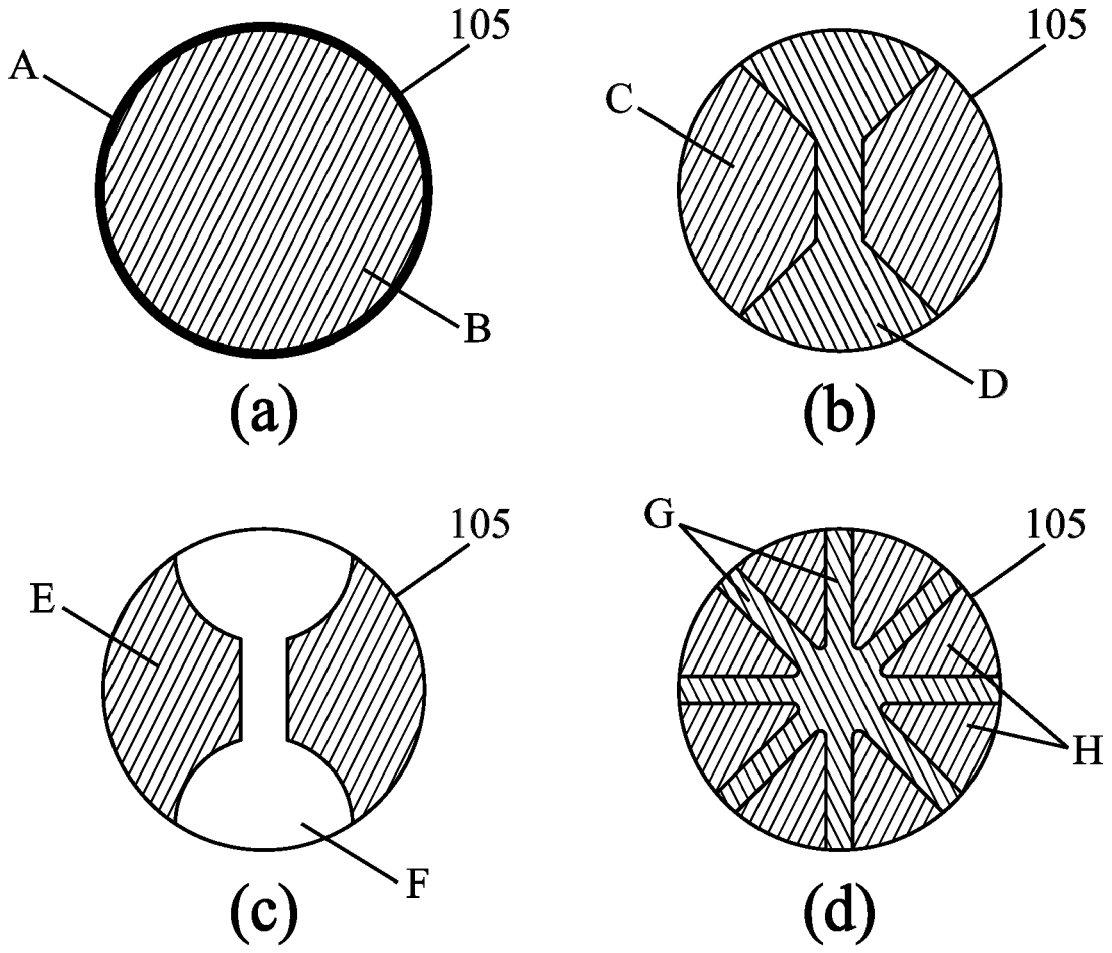
FIG. 21 shows examples of a possible composition of the substantially spherical part of the actuation button.

FIG. 21 shows examples of the actuation button 105. In all the examples, the actuation button 105 includes two different materials. Nevertheless, the number of materials included in the actuation button 105 could be larger. In the following paragraphs, although the references are made to the actuation button 105 of the first embodiment only, the same or similar structures of the actuation button or the substantially spherical part may also be employed in the other embodiments of the invention. The material of the actuation button 105 may have an average density higher or lower than the density of the material of the handle body 102A. The difference between the average density of the actuation button 105 and the density of the material of the handle body 102A can be at least 10% of the density of the material of the handle body 102A.

The actuation button 105 may be made of a plurality of different materials with different densities. Some of these materials could have densities higher than the material of the handle body 102A, and some of these materials could have densities lower than the material of the handle body 102A. Using a combination of multiple materials of the actuation button 105 may have an advantage of both increasing the weight of the handle 102 and providing a gripping and/or rest area for user's finger. The weight increasing materials with the density higher than the material of the handle body 102A could be a high density plastic, metal or other materials. The low density materials with the density lower than the material of the handle body 102A could be a light plastic material, rubber or other suitable materials.

The combination of materials may be selected so that an average density of the plurality of materials is different from the density of the material of the handle body 102A. The difference between the average density and the density of the material of the handle body 102A may be at least 10% of the density of the handle body 102A.

FIG. 21*a* displays a spherical actuation button 105 made of a material B of density higher than the material of the handle body 102A in the inside of the actuation button 105, and a material A of density lower than the density of the material used to manufacture the handle body 102A on the outside of the actuation button 105. Nevertheless, the reversed arrangement of the materials would also be possible.

FIG. 21*b* illustrates a material D in the inside of the actuation button 105 and partially protruding to the outside of the actuation button 105. Alternatively, as depicted on FIG. 21*c* the actuation button 105 may include a single material E and a hollow portion F in the inside. The hollow portion F thus has density equal to zero or very close to zero. FIG. 21*d* shows another example where a material G provided in the center of the spherical actuation button 105 protrudes in various directions towards the outside of the actuation button 105 through a material. The material H could be a weight increasing material with respect to the handle 102 and the material G could be a material suitable for increasing gripping characteristics of the handle, such as rubber. Other variations of the materials with different densities than those illustrated on FIGS. 21*a*-21*d* are also possible. Any of the material A, B, C, D, E, G, and H may be selected among materials with the density either lower or higher than the density of the material of the handle body 102A.

Further, the disclosure includes embodiments according to the following clauses:

Clause 1. A handle (402) for a shaving razor (401) comprising:

a handle body (402A);

an arm assembly having a pair of arms (406) provided on the handle body (402A) and adapted to engage at least a razor cartridge (403) for supporting it, the arms (406) being movable between a rest position for engaging at least the razor cartridge (403) and a release position for disengaging at least the razor cartridge (403);

an actuation button (405) comprising a button body (405B) movably mounted on the handle body (402A) so that it slides substantially along the longitudinal direction of the handle (402), and a substantially spherical part (405A);

wherein the body (405B) of the actuation button (405) cooperates by camming action with the arm assembly so that the actuation button (405) moves the pair of arms (406) into the release position when the button (405) is actuated;

wherein the substantially spherical part (405A) is movably mounted in the button body (405B) substantially perpendicular to the longitudinal direction of the handle (402) between a lifted position when the substantially spherical part (405A) is lifted outside the button body (405B) and a depressed position when the substantially spherical part (405A) is fully depressed inside the button body (405B), the substantially spherical part (405A) being elastically biased toward the lifted position and cooperating with the button body (405B) so as to prevent the button body (405B) from sliding when the substantially spherical part (405A) is in the lifted position and so as to enable the button body (405B) to slide when in depressed position the substantially spherical part (405A) is in the depressed position.

Clause 2. The handle (402) according to clause 1, wherein the substantially spherical part (405A) has a density different from a density of the material of the handle body (402A).

Clause 3. The handle (402) according to clause 2, wherein a difference between the average density and the density of the material of the handle body (402A) is at least 10%.

Clause 4. The handle (402) according to clause 2 or 3, wherein the substantially spherical part includes at least two different materials with different densities.

Clause 5. The handle (402) according to any of the preceding clauses, wherein the substantially spherical part (405A) has an average density higher than the density of the material of the handle body (402A).

Clause 6. The handle (402) according to any of the preceding clauses, wherein at least a portion of the substantially spherical part (405A) is made from metal.

Clause 7. The handle (402) according to any of the preceding clauses, wherein the handle further includes a spring (442); the spring (442) providing a return force for pushing the substantially spherical part (405A) back to the lifted position, when the substantially spherical part (405A) has been pressed towards the fully depressed position.

Clause 8. The handle (402) according to any of the preceding clauses, wherein the button body (405B) includes an extended part (444) for resting user's finger during shaving.

Clause 9. A handle (102, 202, 302, 402) for a shaving razor (101, 201, 301, 401) comprising:

a handle body;

an arm assembly having two arms (106, 206, 306, 406) provided on the handle body and adapted to engage at least a razor cartridge (103, 203, 303, 403) for supporting it, the arms (106, 206, 306, 406) being movable between a rest position for engaging at least the razor cartridge (103, 203, 303, 403) and a release position for disengaging at least the razor cartridge (103, 203, 303, 403);

an actuation button (105, 205, 305, 405) which is movably mounted on the handle body, the actuation button (105, 205, 305, 405) cooperating by cam action with the arm assembly so that the actuation button (105, 205, 305, 405) moves the two arms (106, 206, 306, 406) into the release position when the button (105, 205, 305, 405) is actuated;

characterized in that the actuation button (105, 205, 305, 405) includes a weight component having an average density different from a density of material of the handle body (102A, 202A, 302A, 402A).

Clause 10. The handle (102, 202, 302, 402) according to clause 9, wherein a difference between the average density and the density of the material of the handle body (102A, 202A, 302A, 402A) is at least 10%.

Clause 11. The handle (102, 202, 302, 402) according to clause 9 or 10, wherein the weight component includes at least two different materials with different densities.

Clause 12. The handle (102, 202, 302, 402) according to any of clauses 9-11, wherein the weight component has an average density higher than the density of material of the handle body (102A, 202A, 302A, 402A).

Clause 13. The handle according to clauses 9-12, wherein at least a portion of the weight component is made from metal.

Clause 14. The handle according to any of clauses 9-13, wherein the actuation button (105, 205) itself serves as the weight component.

Clause 15. The handle according to clause 9, wherein the actuation button (105, 205) is movably mounted on the handle body between a lifted position and a depressed position wherein the actuation button (105, 205) is depressed inside the handle (102, 202); the actuation button (105, 205) moving the two arms (106, 206) in the release position when the button (105, 205) is pressed to the depressed position; the two aims (106, 206) being elastically biased toward the rest position; the two arms (106, 206) biasing the actuation button (105, 205) toward the lifted position when the actuation button (105, 205) is released.

A shaver's handle with a lock and release mechanism for engaging and disengaging razor cartridge.

The invention claimed is:

1. A handle for a shaving razor adapted to releasably support a razor cartridge, the handle comprising:

a handle body including an arm assembly having a pair of arms extending in a plane and being adapted to engage the razor cartridge; and an actuation button;

the actuation button being configured to move substantially perpendicular to the plane of the pair of arms;

the actuation button cooperating with the pair of arms for engaging and disengaging the razor cartridge, wherein the pair of arms include proximal parts disposed proximate to the actuation button and distal parts disposed further than the proximal parts from the actuation button, wherein during actuation of the actuation button, the proximal parts move apart while the distal parts simultaneously move closer together to release the razor cartridge from the handle body.

2. The handle according to claim 1, where the pair of arms are elastically biased to move between a rest position when engaged with the razor cartridge and a release position when disengaged with the razor cartridge.

3. The handle according to claim 1, wherein the actuation button is mounted on the handle body to move between a lifted position and a depressed position; the actuation button, in the depressed position, being depressed inside the handle body.

4. The handle according to claim 3, wherein the proximal parts are connectable to the handle body and the distal parts are connectable to the razor cartridge.

5. The handle according to claim 4, wherein the distal parts are configured to abut against two rest projections protruding from each side of the handle when the pair of arms are engaged with the razor cartridge.

6. The handle according to claim 3, wherein the proximal parts include inclined surfaces configured to cooperate with two side portions of the actuation button when the actuation button is in the lifted position.

7. The handle according to claim 3, wherein each of the proximal parts includes a connection portion configured to cooperate with and being movable mounted on the handle body.

8. The handle according to claim 7, wherein an elastic portion is provided between the pair of arms and the connection portion, the elastic portion being configured to generate a return force to facilitate engagement and disengagement of the pair of arms from the razor cartridge.

9. The handle according to claim 1, wherein the proximal parts include an inclined surface; the inclined surfaces being configured to cooperate with two side portions of the actuation button when the actuation button is in a lifted position.

10. The handle according to claim 1, wherein the pair of arms include a pair of openings and the handle includes a pair of pins, each one of the pair of pins being configured to be received, respectively, in the pair of openings, whereby the pair of pins facilitate the simultaneous movement of the distal parts with respect to the proximal parts.

11. The handle according to claim 1, wherein the pair of arms include an elastic portion disposed between and connecting the pair of arms, the elastic portion being configured to generate a return force to facilitate engagement and disengagement of the pair of arms from the razor cartridge.

12. The handle according to claim 11, wherein the elastic portion includes a stop member, the stop member being configured to prevent the elastic portion from reaching a point of permanent deformation and being configured to limit movement of the pair of arms.

13. The handle according to claim 1, wherein the distal parts include shell bearings, the shell bearings being configured to engage with rims provided on the razor cartridge to provide a pivotal movement of the razor cartridge with respect to the handle when the razor cartridge is connected to the handle.

* * * * *